United States Patent [19]

Yasuda et al.

[11] Patent Number: 4,844,469

[45] Date of Patent: Jul. 4, 1989

[54] GOLF TRAINER FOR CALCULATING BALL CARRY

[75] Inventors: Yoshinori Yasuda; Akio Takase; Koji Ogawa; Takao Tsutsumi; Hiroaki Taguchi, all of Gunma, Japan

[73] Assignee: Mitsubishi Denki Kabushiki Kaisha, Japan

[21] Appl. No.: 432,877

[22] Filed: Oct. 5, 1982

[30] Foreign Application Priority Data

| | | | |
|---|---|---|---|
| Oct. 5, 1981 | [JP] | Japan | 56-158433 |
| Oct. 6, 1981 | [JP] | Japan | 56-159165 |
| Feb. 19, 1982 | [JP] | Japan | 57-25288 |
| Feb. 22, 1982 | [JP] | Japan | 57-27245 |
| Feb. 24, 1982 | [JP] | Japan | 57-28436 |
| Feb. 25, 1982 | [JP] | Japan | 57-29692 |

[51] Int. Cl.[4] ..... A63B 69/36

[52] U.S. Cl. ..... 273/186 R; 273/186 C

[58] Field of Search ..... 273/1 M, 11 C, 48, 49, 273/54 A, 181 E, 181 F, 181 G, 181 H, 181 J, 186 R, 186 A, 186 B, 186 C, 186 D; 340/323 R

[56] References Cited

U.S. PATENT DOCUMENTS

| | | | |
|---|---|---|---|
| 4,116,435 | 9/1978 | Sines et al. | 273/11 R |
| 4,150,825 | 4/1979 | Wilson | 273/181 H |
| 4,254,956 | 3/1981 | Rusnak | 273/181 H |
| 4,343,469 | 8/1982 | Kunita et al. | 273/186 C |
| 4,375,887 | 3/1983 | Lynch et al. | 273/186 R |

FOREIGN PATENT DOCUMENTS 3001924 7/1981 Fed. Rep. of Germany .

*Primary Examiner*—Maryann Lastova

*Attorney, Agent, or Firm*—Sughrue, Mion, Zinn, Macpeak, and Seas

[57] ABSTRACT

A golf trainer includes magnetic sensors for detecting the passage of a golf club head and is provided with a device for electronically measuring the speed of the club. The carry of the ball is also calculated, except when the club selected for use is a putter, from data regarding the club selected and the characteristics of the speed of this club versus the carry of the ball.

20 Claims, 23 Drawing Sheets

| CASE | ORDER OF PASSAGE | | | CALCU. OF SPEED V INITATED ? YES---O NO---X |
|---|---|---|---|---|
| | SENSOR 6b | SENSOR 6c | SENSOR 6d | |
| 1 | 1 | 2 | 3 | O |
| 2 | 1 | 3 | 2 | O |
| 3 | 2 | 1 | 3 | X |
| 4 | 2 | 3 | 1 | X |
| 5 | 3 | 1 | 2 | X |
| 6 | 3 | 2 | 1 | X |
| 7 | PASS OVER NO SENSORS | | | X |

GOLF TRAINER FOR CALCULATING BALL CARRY

BACKGROUND OF THE INVENTION

The present invention relates to a golf trainer, and more particularly, to the control of a display portion of a microprocessor controlled golf trainer, and to the construction of a golf trainer adapted to display various parameters relative to a given club swing.

Heretofore, most golf trainers have had mechanical structures. For example, a trainer using a spring or the like is provided with a corded ball connected to the spring by the cord. The ball is hit by the golf club, and the stress occurring in the spring is measured with a scale to display the carry of the ball corresponding to the stress. Thus, the carry cannot be indicated accurately. Also, this prior art device utilizes a corresponding relation between the carry of the ball and the stress of a spring to indicate the carry, and therefore if a half shot, for example, is taken, the carry may not be displayed, because that carry may correspond to a value outside the range of stress displayable.

In the display of the carry, if the club is an iron, wood or the like, then the carry will be a meaningful piece of information. However, if the club is a putter, carry will be by no means meaningful, and should not be displayed on the display device.

Recent progress in semiconductor technique has lowered the prices of LSIs, such as microprocessors, and golf trainers using such LSIs have been proposed by the present applicant and others. Generally, movement of a swinging club head is detected by magnetic sensors, infrared sensors and so on, and various information relative to a swing, such as the speed of the club head, can be very accurately displayed.

In reality, such movements sometimes entail movements other than normal swings, for example a takeback or reverse swing, which should not be displayed. It would be helpful in practice to make such extraneous swings not trigger the display and to hold the previous data in the display portion.

Moreover, however, microprocessors now available yet lack the capacity to process a large quantity of highspeed information rapidly and accurately at a given time.

SUMMARY OF THE INVENTION

In view of the foregoing, it is an object of the present invention to provide a golf trainer implemented in semiconductor circuitry. Specifically, a central processing unit for calculating the carry of a ball based on statistical data defining the interrelationships between the speed of a club head and the carry of a ball is used to produce a signal indicative of the carry, and a display portion displays the output from the central processing unit, whereby any carry can be accurately displayed for a wide range of values.

It is a further object of the present invention to provide a golf trainer which however does not display the carry when a putter is the selected club, or when the swing is judged to be an extraneous one, such as a backswing or the like.

In view of the foregoing, it is also an object of the present invention to provide a golf trainer which includes a plurality of sensors for detecting a swinging club head, an oscillator circuit for generating high frequency clock pulses, counter circuits for counting the number of clock pulses generated during the period of time it takes for the club head to pass through the respective intervals between the sensors, microprocessors for receiving outputs from the counter circuits and for producing outputs indicative of the results of processing performed therein, and a display portion for displaying the outputs from the microprocessor as data concerning the swing, in a rapid and accurate fashion.

DETAILED DESCRIPTION OF THE PREFERRED EMBODIMENTS

Figure 1:
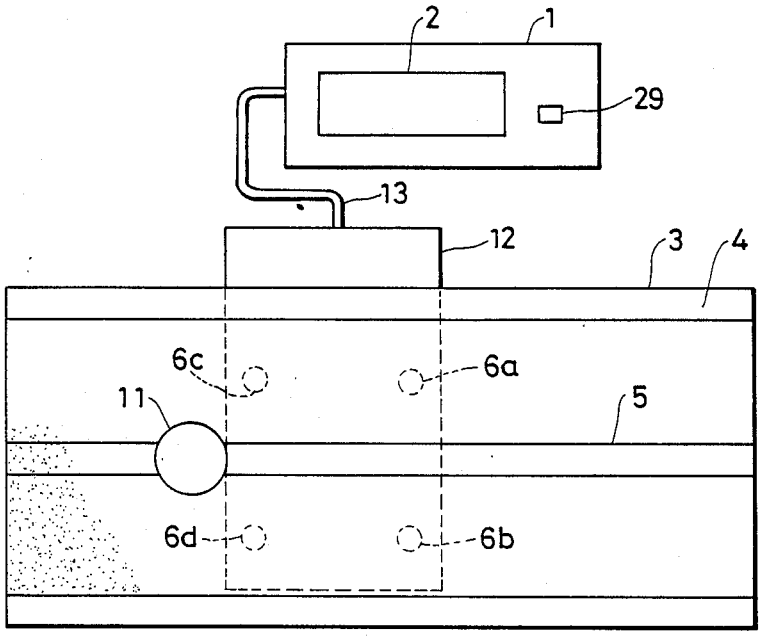
FIG. 1 is a plan view illustrating one embodiment of the present invention.
Figure 2:
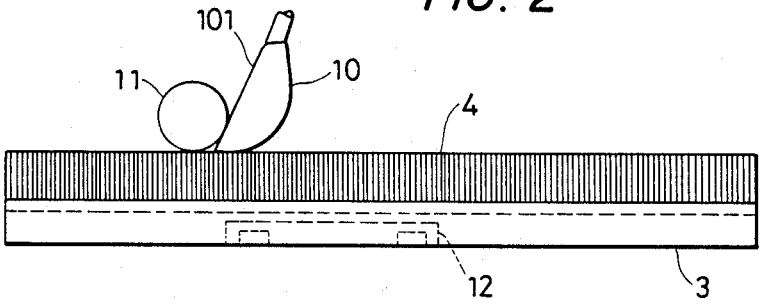
FIG. 2 is an elevation of the first embodiment.
Figure 3A:
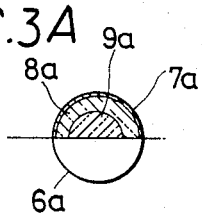
FIGS. 3A and 3B show a magnetic sensor of the embodiment in plan and elevational views respectively.
Figure 3B:
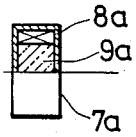

Referring to FIGS. 1–3, there are shown the body of a golf trainer 1 having a control circuit 30 (described later), a display portion 2, a club selecting key 29, a base mat 3, a lawn-like golf mat 4 placed on the base mat, a white line 5 drawn on the center of the golf mat to indicate the swing direction of a club head 10, and a golf ball 11 (which is used in this embodiment, but not necessarily required). Magnetic sensors **6*a*, 6*b*, 6*c* and 6*d* consist of permanent magnets 9*a*, 9*b*, 9*c* and 9*d*, coils 8*a*, 8*b*, 8*c* and 8*d* wound on the respective permanent magnets with a predetermined number of turns, and highly electro-conductive cases 7*a*, 7*b*, 7*c* and 7*d*** housing these elements, respectively.

Figure 4:
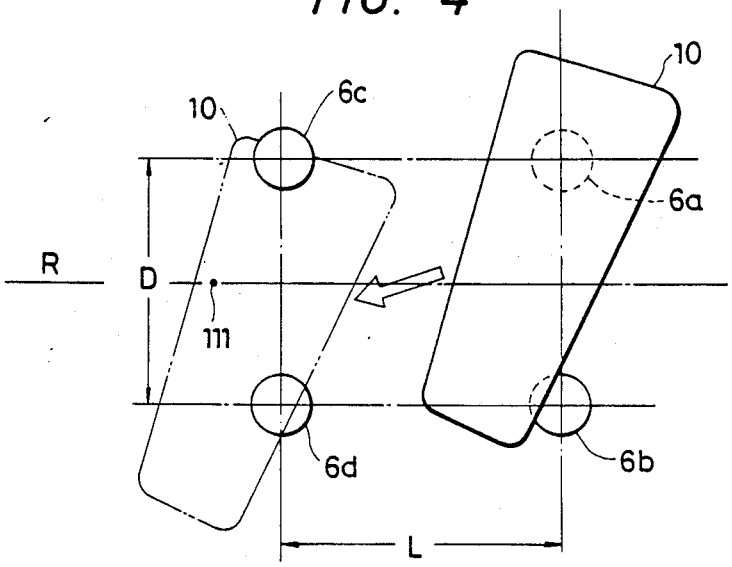
FIG. 4 is a schematic representation of a club head and a sensor when an exemplitive swing is taken.

The magnetic sensors are buried in a sensor case 12. The magnetic sensors **6*c* and 6*d* are disposed as shown in FIG. 4 on opposite sides of the center line R of an ideal swing orbit of the golf club, near a position 111 at which the ball is placed, at a predetermined distance of D/2, for example 25 mm, from the center line R. Magnetic sensors 6*a* and 6*b* are disposed at a given interval L, for example 50 mm, in the direction in which the golf club enters. The sensor case is installed in the base mat 3, and signals from the sensor case are fed to the body of the trainer 1 through a signal line 13**.

Figure 5:
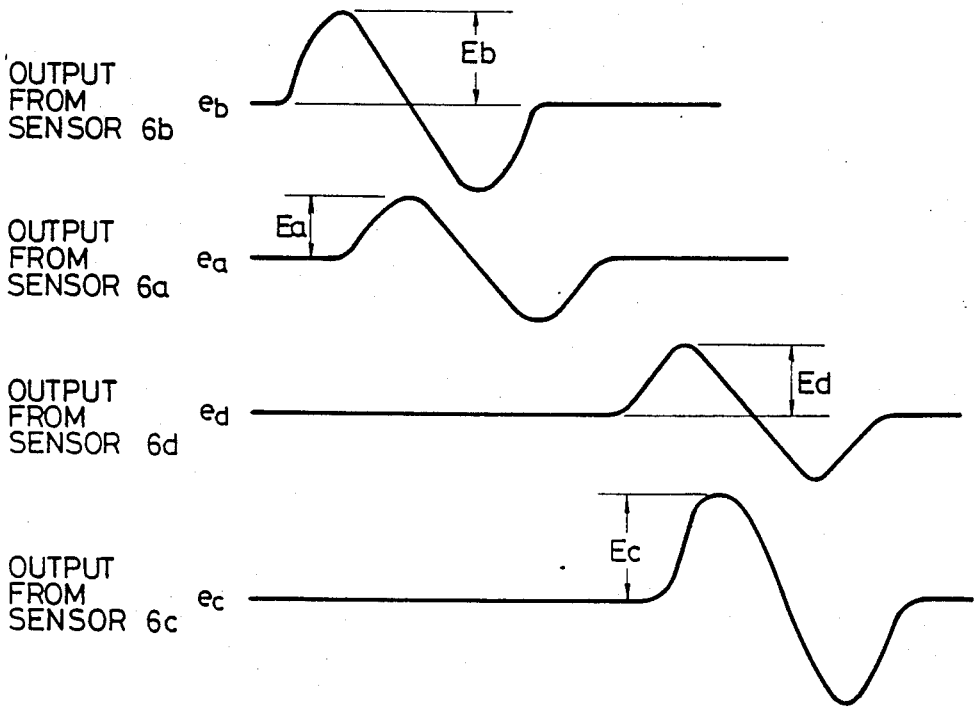
FIG. 5 is a waveform chart of the amplified outputs from the sensors in the case of the swing of FIG. 4.
Figure 6:
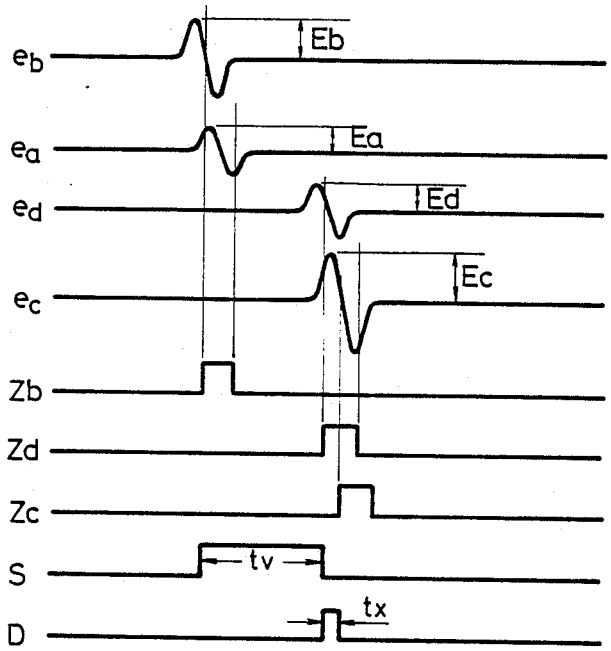
FIG. 6 is a timing chart corresponding to FIG. 5.
Figure 7:
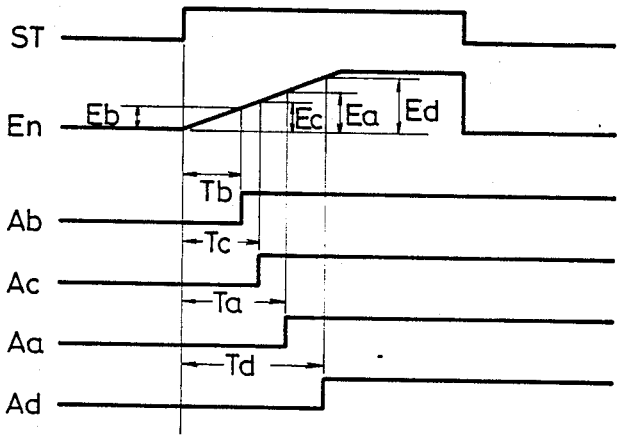
FIG. 7 is a view illustrating the conversion of the peak voltage values from the sensors into times.

Referring now to FIGS. 4–7, an example of the detection operation will be described. When the club head 10 moves in the direction indicated by the arrow upon swinging, as shown in FIG. 4, the sensors produce output signals as shown in FIG. 5, which are in turn converted to digital signals as shown in the timing chart of FIG. 5. Then, the difference $t_y$ between the occurrences of outputs from the sensors **6*b* and 6*d* and the time difference $t_x$ between outputs from the sensors 6*d* and 6*c* are measured. Further, output voltages $E_a$, $E_b$, $E_c$ and $E_d$ from the respective magnetic sensors 6*a*, 6*b*, 6*c* and 6*d* are converted to timing signals having time widths corresponding to their respective voltage values as shown in FIG. 7**.

The structure described hereinbefore permits calculations of the following various information relative to a swing: (1) club head velocity, (2) carry of the ball, (3) face offset angle, (4) the hitting position of the face, (5) hit direction, and (6) distance from a desired target.

With respect to club head velocity, the velocity $V_O$ is approximately calculated using the relation $L/t_y = V_o$.

With respect to ball carry, this is calculated from club data individually set for various clubs, and the aforementioned club head velocity.

With respect to the face offset angle $\alpha$, this can be approximately calculated from $$\alpha = \mathrm{Tan}^{-1}\left(\frac{t_x}{t_y} \times \frac{L}{D}\right).$$

With respect to the hitting position on the club head, the hitting position of the face 101 of the club head 10 can be calculated by comparison between the time widths $T_c$ and $T_d$.

With respect to the blow delivered by the club, the direction in which the club head 10 was moved is calculated by comparison between time widths $T_a$ and $T_b$ and between time widths $T_o$ and $T_d$.

Finally, with respect to the distance from target, this can be calculated from the carry of the ball based on the face offset angle and the hit direction.

Figure 8:
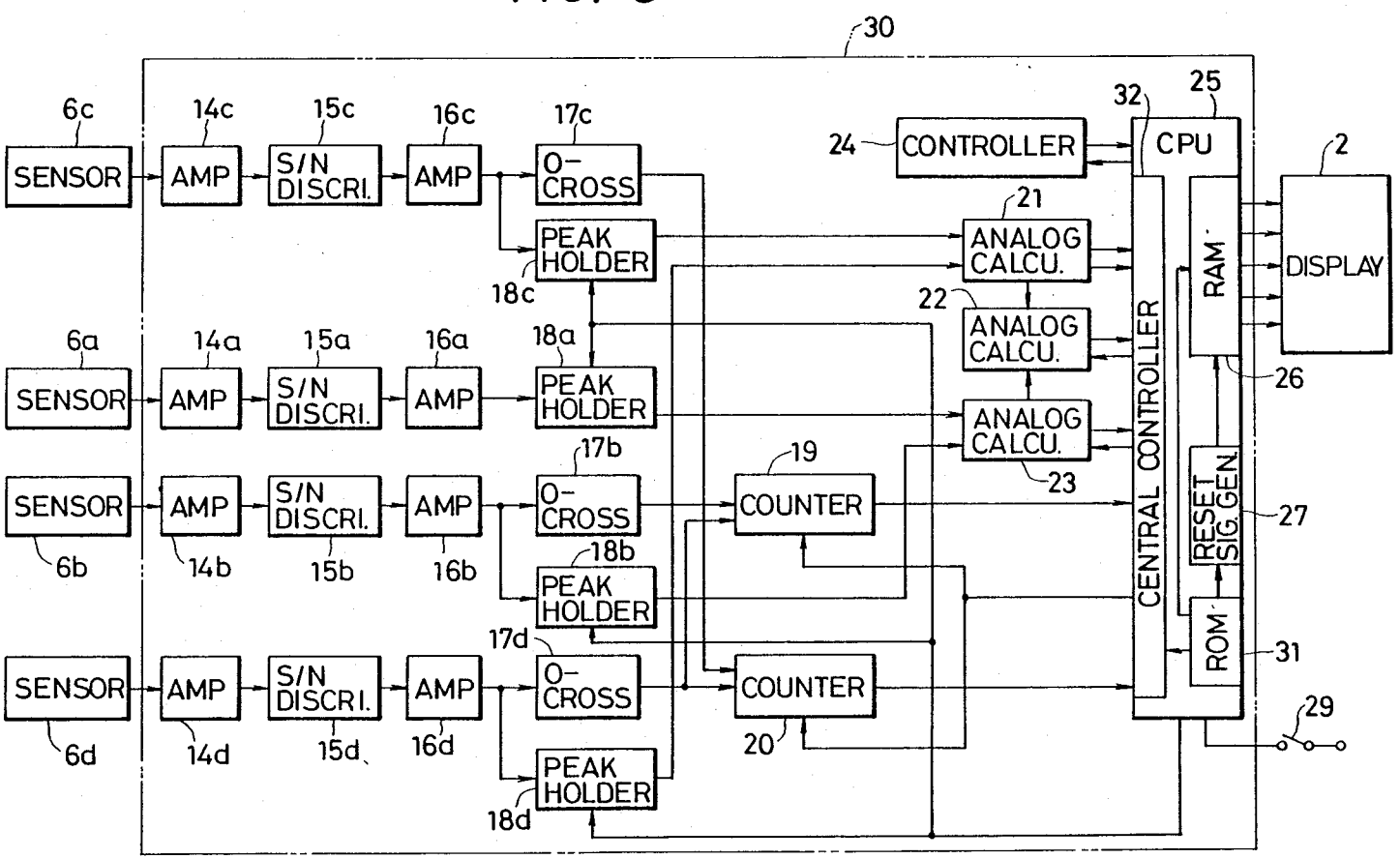
FIG. 8 is a block diagram of the control circuit.
Figure 9:
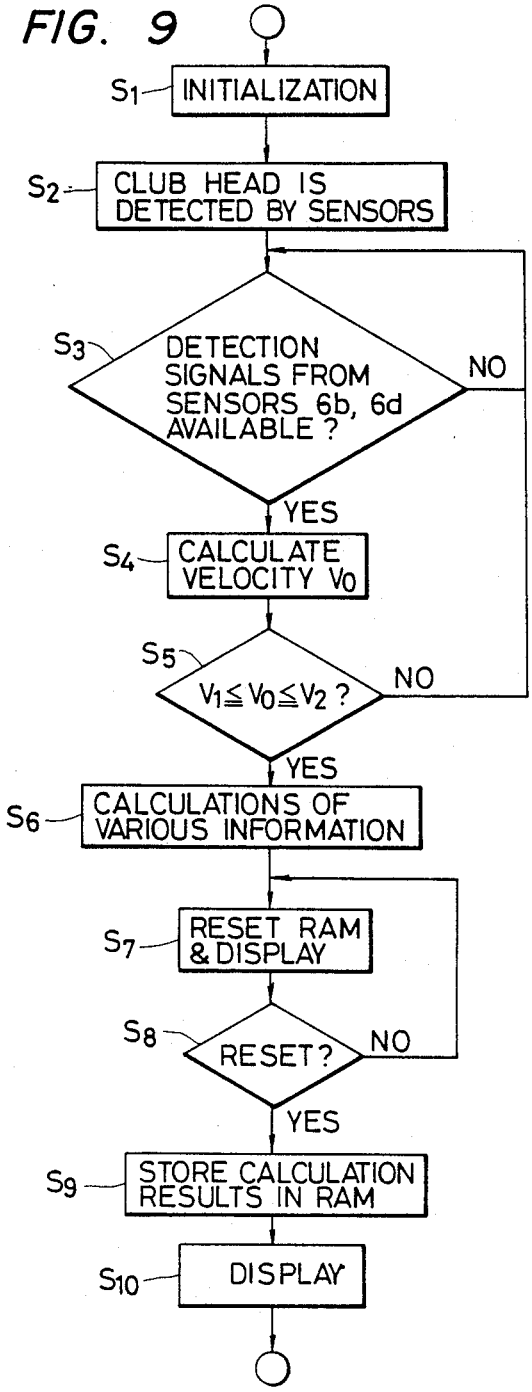
FIG. 9 is a flow chart showing the calculations and display process of the invention and the production of a reset signal that resets a memory.

The control circuit 30 of the invention utilizing the principles of detection described hereinbefore will be described in detail in the following. Referring to FIG. 8, amplifiers **14*a*, 14*b*, 14*c* and 14d amplify the signals from the magnetic sensors 6*a*, 6*b*, 6*c* and 6*d* by a given gain factor. SN discriminators 15, 15*b*, 15*c* and 15d discriminate the necessary signals from among hte output signals of the amplifiers 14*a*, 14*b*, 14*c* and 14d. Amplifiers 16*a*, 16*b*, 16*c* and 16*d* amplify outputs from the SN discriminators 15*a*, 15*b*, 15*c* and 15*d* by a given gain factor to produce output signals $e_a$, $e_b$, $e_c$ and $e_d$, respectively. Zero-crossing detectors 17*b*, 17*c* and 17*d* shape the amplified signals $e_b$, $e_c$ and $e_d$ into pulse signals and produce signals $Z_b$, $Z_c$ and $Z_d$, respectively. Peak holders 18*a*, 18*b*, 18*c* and 18*d* hold the peak values of the amplified signals $e_a$, $e_b$, $e_c$ and $e_d$ and produce voltage values $E_a$, $E_b$, $E_c$ and $E_d$, respectively. A counter circuit 19 produces a signal S from the pulse signals $Z_b$ and $Z_d$ and measures the time $t_y$ from the signals S, while a counter circuit 20 produces a signal D from the pulse signals $Z_c$ and $Z_d$ and measures the time $t_x$ from the signal D. An analog calculator 21 produces time signals $A_c$ and $A_d$ from the voltage values $E_c$ and $E_d$ based on signals ST and $E_n$, and an analog calculator 23 produces time signals $A_a$ and $A_b$ from the voltage values $E_a$ and $E_b$ based on the signals ST and $E_n$. An analog calculator 22 compares the time width $T_c$ with $T_d$ and the time width $T_a$ with $T_b$, the time widths $T_a$, $T_b$, $T_c$ and $T_d$ corresponding to the voltage values $E_a$, $E_b$, $E_c$ and $E_d$ of the time signals $A_c$, $A_d$, $A_a$ and $A_b$, respectively, and calculates the time difference between them to produce these results as outputs. A central controller 32 receives the outputs from the counter circuits 19, 20 and analog calculators 21, 23, and 22 and calculates (1) the club head velocity, (2) the carry, (3) the face offset angle, (4) the hitting position on the club face, (5) the hitting direction and (6) the distance from target. The data derived from the central controller are temporarily stored in a RAM (random access memory) 26. Programs for controlling operations instructed by a flow chart shown in FIG. 9 are stored in a ROM (read only memory) 31, which in turn controls a reset signal generator 27 for generating reset signals resetting the RAM 26 and a display portion 28 (described later) when necessary. The aforementioned central controller 32, RAM 26, ROM 31 and reset signal generator are incorporated in a central processing unit 25 which consists of a microprocessor, for example. A controller 24 produces timing signals for controlling the central processing unit, counter circuits 19 and 20 and analog calculators 21, 23 and 22. Club data, which are individually preset for various clubs and stored may be selected by use of a club key 29. The contents of the RAM are displayed on the display portion 2**.

The structure described hereinbefore allows a user to depress the club selecting key 29 for selecting the club used, and if a swing is taken, various information relative to the swing will be detected and displayed. It will be understood that some swings pass over no sensors, and some users may erroneously swing a club over the sensors too gently. In such cases, the previous state of display is preferably maintained, and if a correct swing is taken, it is necessary to automatically reset the previous data displayed and to display the current information. For these reasons, in this embodiment, the above operations are controlled in accordance with the flow chart shown in FIG. 9. Referring to FIG. 9, the control circuit 30 is initialized and waits for the arrival of detected signals from the sensors. Then, it is judged whether detected signals from the sensors 6b and 6d are available. If so, the head velocity $V_o$ is calculated based on the signals from the sensors. Then, it is judged whether the head velocity $V_o$ is within a certain range, for example, 0.1 m/sec$\leqq V_o \leqq$60 m/sec. If not, the swing is judged to be erroneous, such as a trial swing for an approach shot, and the flow returns to process step S2. If so, the swing is judged to be a correct one, and various information is calculated relative thereto. The RAM 26 and display portion 2 are then reset. Next, it is judged whether the display portion 2 and RAM 26 have been reset. If not, the process S7 is repeated. If so, the data are stored in the RAM 26, and the contents are displayed by the display portion 2.

The aforementioned lower limit of the club head velocity has been set at near the lowest velocity of a putter; and the upper limit has been defined from the fact that even a professional golfer cannot attain a velocity exceeding some 55 m/sec, and with a view to eliminating malfunction of the sensors due to electromagnetic noise.

In the above embodiment, swings whose head velocities $V_o$ are within a certain range are judged to be correct. However, alternatively, all swings whose head velocities exceed a predetermined value may be judged to be correct. Also, the same result may be obtained by judging using data based on head velocities. Further, if a signal indicative of the passage of a club head from at least one sensor is available, then the swing may be judged to be correct. Furthermore, it is obvious that the number of the sensors is not restricted to four.

Figure 10:
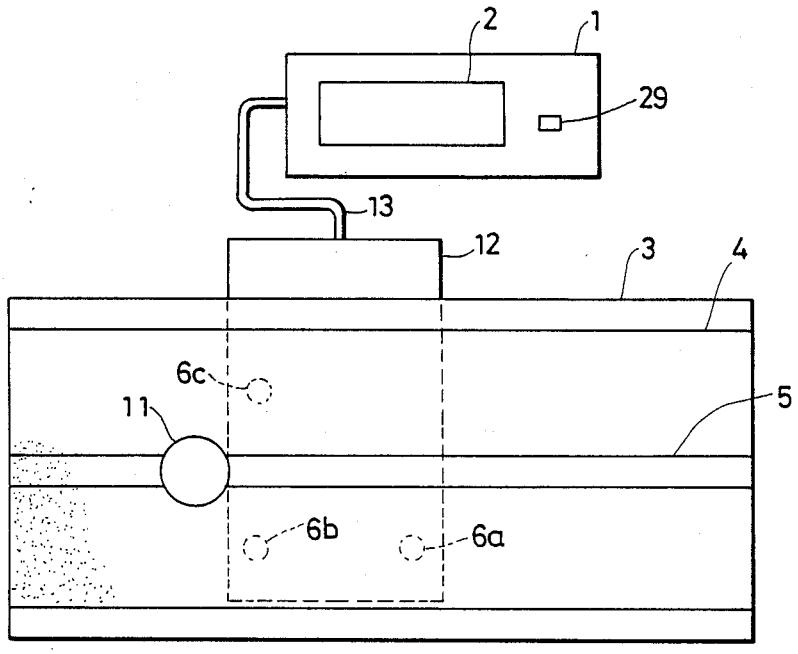
FIG. 10 is a plan view illustrating another embodiment of the present invention.

Referring next to FIG. 10, a second embodiment of the invention dealing with the detection and calculation of the carry will be described. The arrangement of the device is identical with that shown in FIGS. 1–3, except that one of the sensors 6a, 6b may be deleted.

Figure 11:
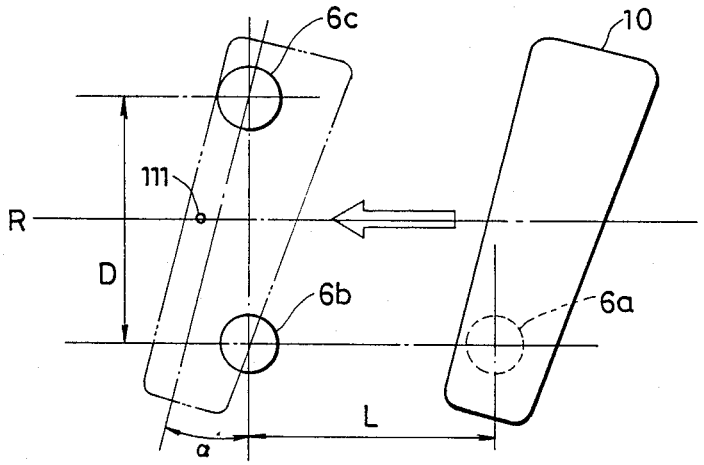
FIG. 11 is a view illustrating the interrelationship between a simplified club head and simplified sensors when a swing is taken.
Figure 12:
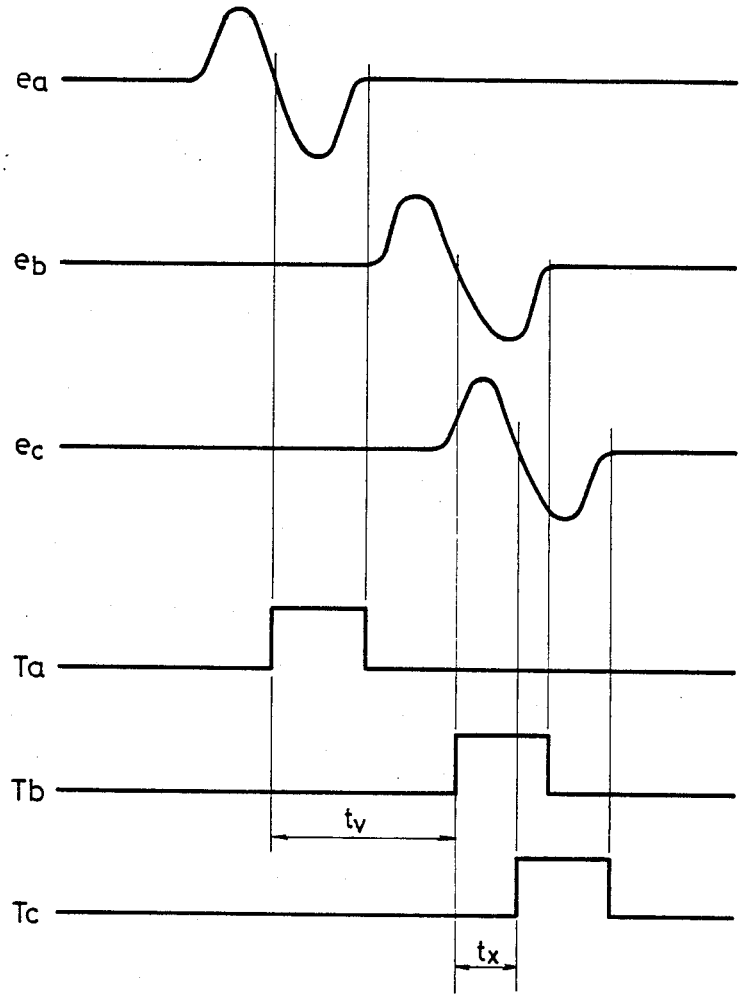
FIG. 12 shows the outputs of the magnetic sensors in the case of FIG. 11 and illustrates the timing of the outputs.

Referring to FIGS. 11 and 12, an example of detection is described. If the club head moves in the direction indicated by the arrow upon swinging as shown in FIG. 11, the outputs from the sensors will be the signals $e_a$, $e_b$, $e_c$ as shown in FIG. 5. These signals are converted to digital signals $T_a$, $T_b$ and $T_c$ as shown in FIG. 12, and the time difference $t_y$ between signals generated by the magnetic sensors 6a and 6b and the time difference $t_x$ between signals from the magnetic sensors 6b and 6c are measured.

Figure 13:
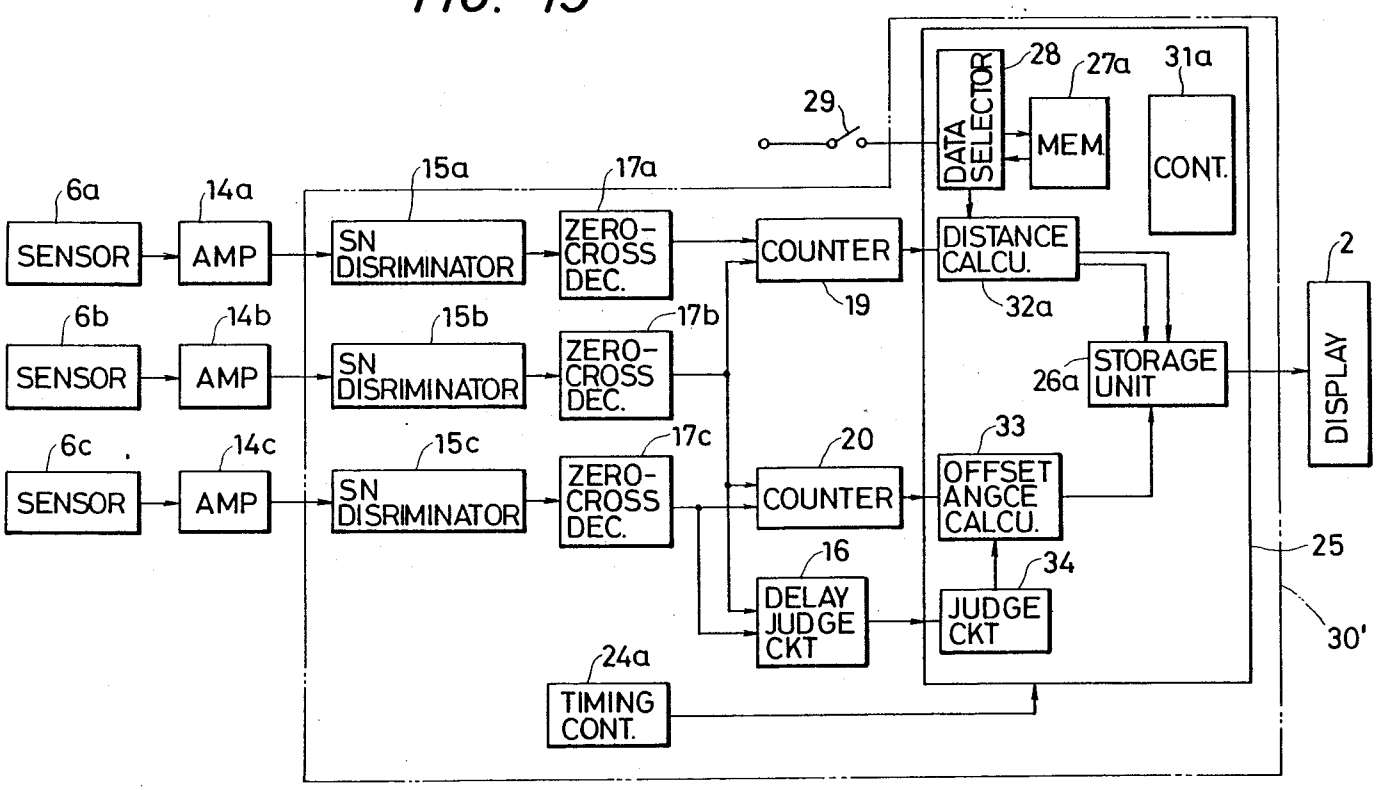
FIG. 13 is a block diagram of a control circuit.

The control circuit 30' utilizing the principles of detection described hereinbefore will be described in detail in the following. Referring to FIG. 13, amplifiers 14a, 14b and 14c amplify minute signals from the magnetic sensors 6a, 6b and 6c by a given gain factor, and SN discriminators 15a, 15b and 15c discriminate the necessary signals concerning detected signals indicative of the swinging state from output signals from the amplifiers, which signals also include noise. Zero-crossing detectors 17a, 17b and 17c further amplify the signals $e_a$, $e_b$ and $e_c$, and each selects a zero-crossing point of electromotive force at which lines of magnetic force assume a maximum value in order to derive a signal from a fixed position on the sole of the club head 10 irrespective of its shape, although the club head may take many shapes. The detectors then produce signals $T_a$, $T_b$ and $T_c$ in the form of pulses rising at such zero-crossing points. A counter circuit 19 measures the time $t_y$ from the pulse signals $T_a$ and $T_b$, while a counter circuit 20 measures $t_x$ from the pulse signals $T_b$ and $T_c$. A signal delay judging circuit 16 judges the direction in which the club face is shifted from the pulse signals $T_b$ and $T_c$. A club data memory 27a stores predetermined club data individually set for various clubs, and a club data selector 28 is controlled by the memory in accordance with the flow chart shown in FIG. 14, and appropriately selects club data according to the desired club. A velocity and distance calculator 32a calculates a club head velocity based on the time $t_y$ from the counter circuit 19 and derives the distance from the velocity and the club data selected by the club data selector 28 in accordance with predetermined calculations.

A face offset angle calculator 33 calculates the offset angle of the club face based on the time $t_x$ from the counter circuit 20, and a face orientation judgment unit 34 judges whether the data from the face offset angle calculator 33 is shifted counterclockwise (positive) or clockwise (negative), based on the signal from the signal delay judging circuit 16. A storage unit 26a temporarily stores data calculated by the velocity and distance calcualtor 32, face offset angle calculator 33 and face orientation judgment unit 34. A controller 31a controls the operations illustrated by the flow chart in FIG. 14, and stores programs which control the velocity and distance calculator 32, face offset angle calculator 33, face orientation judger 34 as well as the storage and display of the results of the calculations. The display portion 2 displays the contents of the storage unit 26a. A central processing unit 25 consisting of a microprocessor includes the aforementioned velocity and distance calculator 32a, fact offset angle calculator 33, face orientation judger 34, storage unit 26a, controller 31a, club data memory 27a, and club data selector 28. A timing controller 24a generates timing signals for controlling the central processing unit, counter circuits 19, 20 and signal delay judger 16.

The aforementioned structure permits calculation of the following values associated with a swing: (1) the velocity of club head, (2) the carry of the ball and (3) the face offset angle.

First, with respect to the velocity of club head, this is approximately calculated by the relation described previously, i.e., $L/t_y$.

With respect to ball carry, this is obtained by a predetermined calculation from the predetermined club data set for individual clubs and the aforementioned club head velocity $V_o$. As an example, if the club data is a coefficient of restitution $K_v$ of a golf ball relative to a particular golf club, which coefficient varies in response to club head velocity $V_o$, then carry will be calculated by $V_o \times K_v$.

With respect to the face offset angle, this is approximately calculated as before by:

$$\alpha = \mathrm{Tan}^{-1}\left(\frac{t_x}{t_y} \times \frac{L}{D}\right).$$

Figure 14:
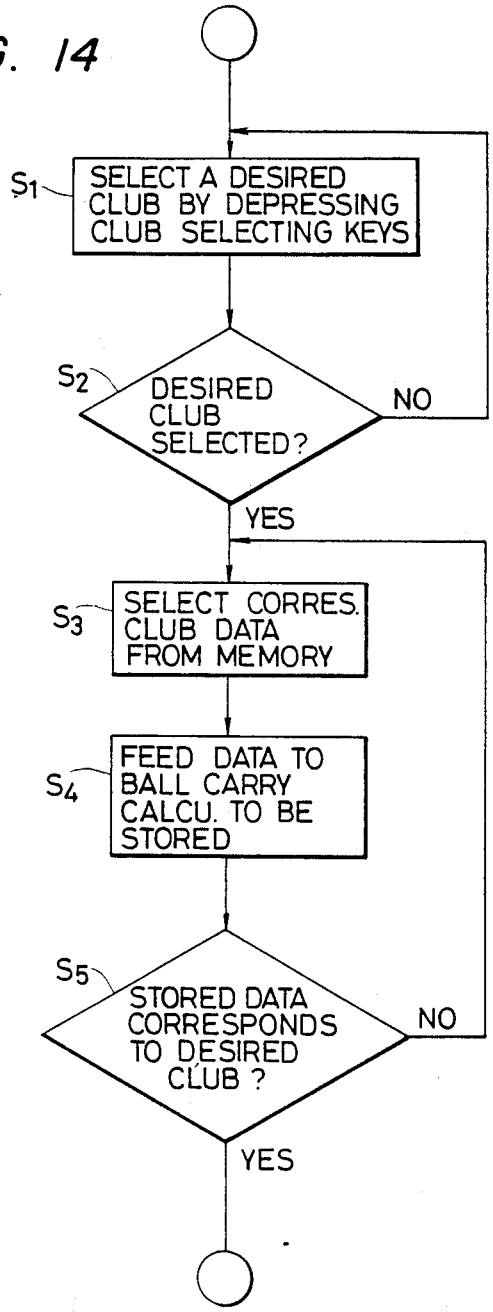
FIG. 14 is a flow chart illustrating club data selection.

FIG. 14 is a flow chart for controlling the operations of the club data selector 28. First, a club selecting key 29 is depressed to select a desired club (S1), and thereafter it is confirmed that such club has been selected (S2). Then, corresponding club data is selected from the club data memory 27*a* (S3), and the selected club data is fed to the velocity and distance calculator 32*a* and stored (S4). Then, it is judged whether club data corresponding to the desired club head is stored in the velocity and distance calculator 32 (S5). If not, the flow will return to process step S3, and if so, the flow chart is terminated.

In the operation of this embodiment as described above, the club selecting key 29 is depressed to select the golf club to be used, and then a swing is taken, whereupon various values concerning the swing are calculated and displayed.

The above embodiment uses three magnetic sensors to detect the swing state of a club head. However, the number is not restricted to three, and any means which can detect the swinging state and calculate the velocity of the club head can be used. It is also noted that any means which can calculate the carry of a golf ball from club data corresponding to each kind of golf club or in accordance with programs corresponding to each kind of golf club head can be used.

Another embodiment of the present invention will hereinafter be described with reference to FIGS. 15–21.

Figure 15:
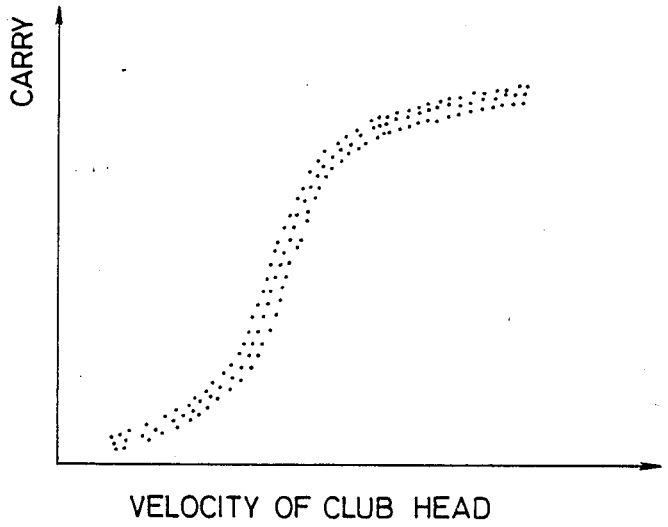
FIG. 15 is a statistical graph illustrative of the interrelationship between the speed of an iron or a similar club head and the carry of a ball.
Figure 16:
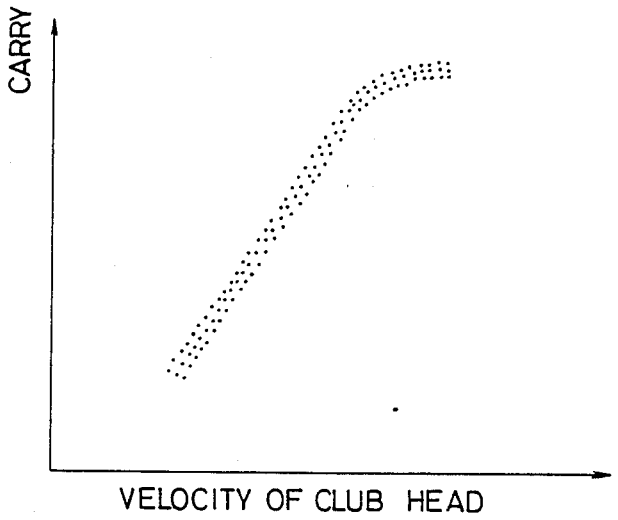
FIG. 16 is a statistical graph illustrative of the interrelationship between the speed of a wood or a similar club head and the carry of a ball.
Figure 17:
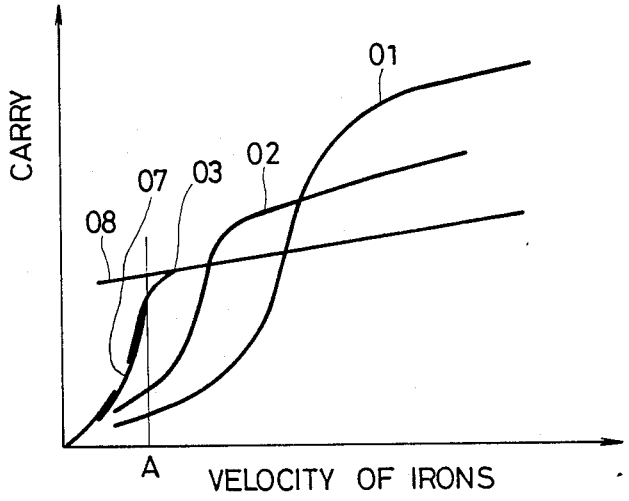
FIG. 17 is a graph illustrative of the above interrelationship where typical irons are used.
Figure 18:
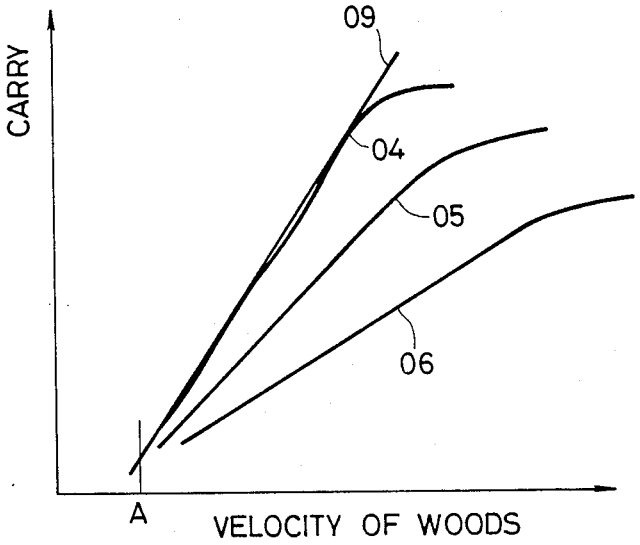
FIG. 18 is a graph illustrative of the above interrelationship where typical woods are used.

FIG. 15 shows the interrelationship between the carry of a ball appropriately hit by an iron or a similar club and the speed of the club head. FIG. 16 shows the interrelationship between the carry of an appropriately hit ball hit by a wood or a similar club, and the speed of the club head. FIGS. 17 and 18 show the center lines of the curves of FIGS. 15 and 16, respectively, derived from typical clubs. Specifically, curves 01–06 are derived from a number three iron, a number five iron, a sand wedge, a number one wood, a number three wood and a number four wood, respectively. The curves of the irons are represented by a combination of a quadratic curve 07 and a linear curve 08 joined at a point of inflection A to convert speeds into carries. The curves of the woods are represented by a linear curve 09 to convert the speeds into carries.

Figure 19:
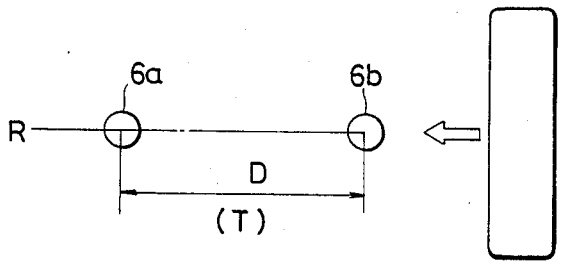
FIG. 19 is a view illustrative of the relationship between a simplified sensor and a simplified club head.
Figure 20:
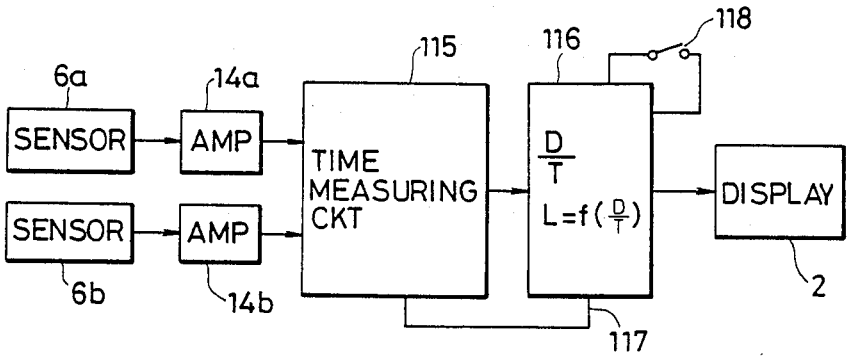
FIG. 20 is a block diagram of an electric circuit of this embodiment of the present invention.

Referring next to FIGS. 19 and 20, there is shown a block diagram of an electronic circuit for calculating carries. A pair of sensors 6*a* and 6*b* for detecting a club head are disposed along the center line R of an ideal swing orbit of the head at an interval D near a position in which a ball is placed. First stage amplifier circuits 14*a* and 14*b* amplify detected signals indicative of the passage of the club head just over the sensors by a given factor. A time measuring circuit 115 receives outputs from the first stage amplifier circuits and measures the period of time T it takes for the club head to pass through the interval between the sensors. A central processing unit 116 consisting of a microprocessor, for example an MPD-7502G, is started by a start signal 117, which is produced by the time measuring circuit 115 when the club head passes a predetermined sensor such as sensor 6*a*. The central processing unit 116 is composed of a speed calculation circuit which calculates a club head speed D/T from the aforementioned time T and a carry calculation circuit which calculates the carry L resulting from a club head selected by a club selecting key 18, for example a sand wedge. A display portion 2 consisting of a liquid crystal display device displays the calculation results from the central processing unit in the form of the carry or club head speed.

Figure 21:
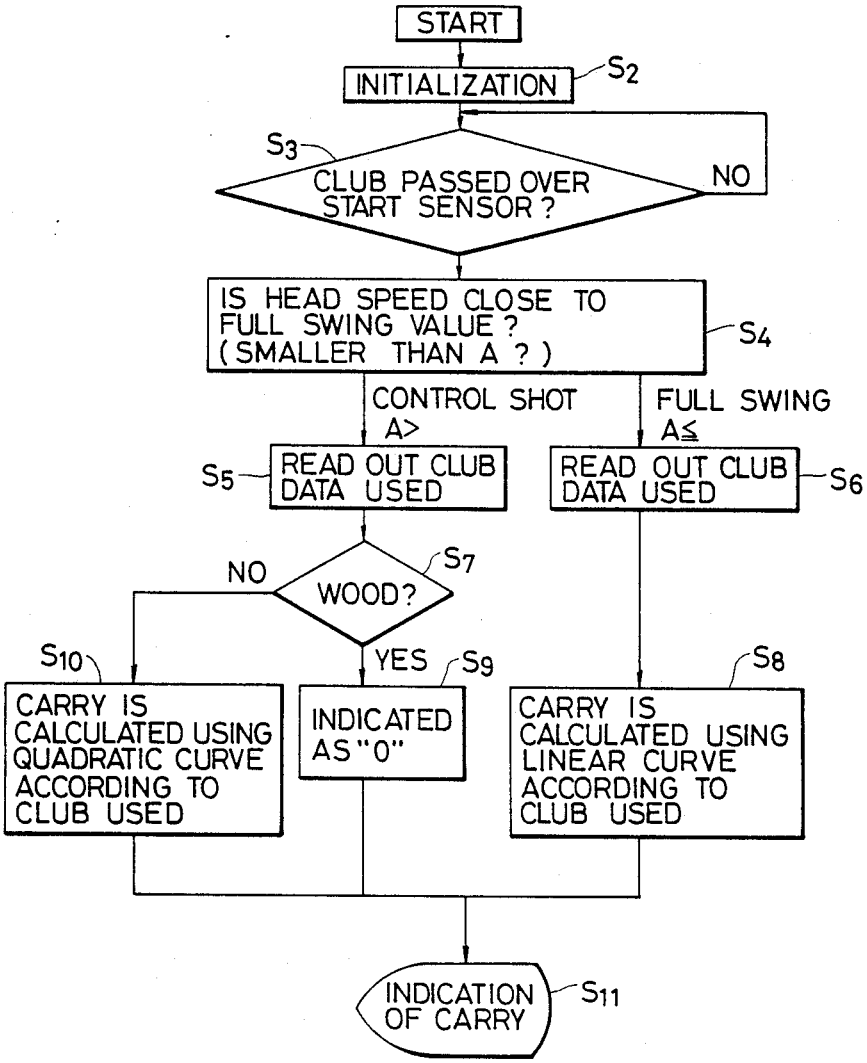
FIG. 21 is a flow chart illustrating the operations performed in the calculation and display of carry data.
Figure 22:
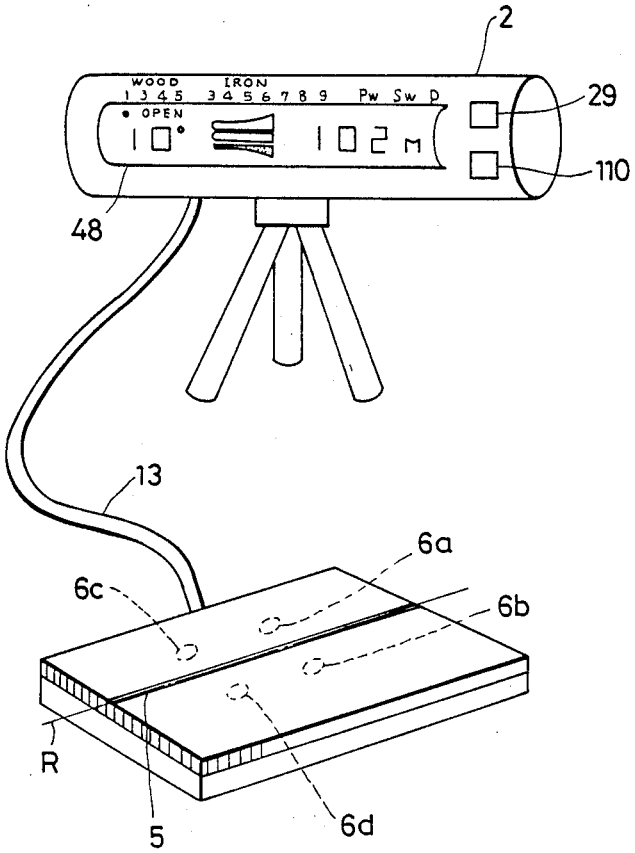
FIG. 22 is a perspective view of a further embodiment of a golf trainer of the present invention.

Referring to the flow chart shown in FIG. 21, calculation or processing performed by the central processing unit 116 are described.

First, initialization including the selection of a club is made (S2), and then the club head is swung. If the club head passes over the sensor causing starting, for example the sensor 6*a*, the process advances to step S4, where the head speed of the club is judged as to whether it is lower than a predetermined speed A. If it is lower than A, the flow proceeds to a process S5, in which the selected club data is read out. Then, the club head is judged as to whether it is a wood (S7). If it is a wood, the carry is indicated as "0 meters", because the shot was substantially missed (see FIGS. 17, 18). If the club head is an iron or a similar club head rather than a wood, the flow proceeds to step S10, where the carry is calculated using the quadratic curve 07 shown in FIG. 17. If the head speed is higher than A, the flow proceeds to process S6, in which the carry is calculated using the linear curves 08 and 09 as shown in FIGS. 17 and 18. The result is displayed as the carry on the display portion 2 (S11).

The calculations thus described permit displays of carries within a range of error which causes practically no substantial problems. Further, the invention is advantageous in that the central processing unit can have a simple structure, and therefore an ordinary microprocessor or the like can be used.

A further embodiment of the present invention will now be described with reference to FIGS. 22–29.

A white line 5 is drawn on the base mat along the center line R of an ideal club head swing orbit. Magnetic sensors 6*a*–6*d* are buried in the base mat along the ideal orbit and on the opposite sides of the center line R at a given interval. A display device 2 incorporates a central processing unit, for example, an MPD-7502G, described later, a display portion 48 (display means) consisting of liquid crystal display devices, a club selecting key 29 which can be externally actuated, and a carry/head speed changeover key 110 which can also be externally actuated.

Figure 23:
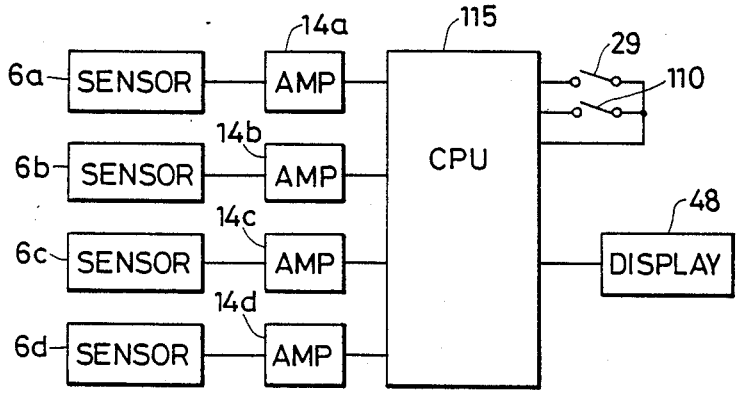
FIG. 23 is a block diagram of an electronic circuit of this trainer.

Referring now to FIG. 23, the steps of calculation or processing of various information relative to a swing performed by this structure will be described. Amplifier circuits 14*a*–14*d* receive respective detected signals from the sensors at each passage of a club head just over the sensors, and the circuits amplify the signals by a given factor to produce amplified signals. The central processing unit 115 receives the outputs from the amplifier circuits 14*a* 14*d* and, conditioned by the data selected by the club selecting key 29 and carry/club speed changeover key 110, calculates club head speed, face angle and carry in accordance with the flow chart shown in FIG. 24 to thus produce such data as outputs. The display portion 48 receives the results of the calculations from the central processing unit 115 and displays them digitally. As can be seen from the flow chart, the carry is not calculated in this embodiment when a putter is used.

Figure 25:
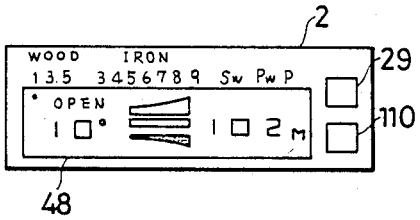
FIG. 25 is an example of a display in which a one wood and the carry are selected.
Figure 26:
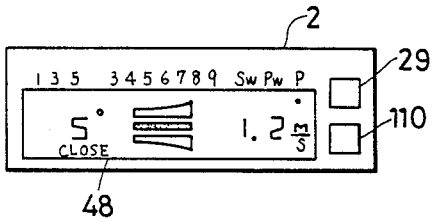
FIG. 26 is an example of the display when a putter is selected.

FIG. 25 shows an example of the display in which the club head speed and a number one wood are selected, while FIG. 26 shows an example of the display when the putter is selected.

Figure 27:
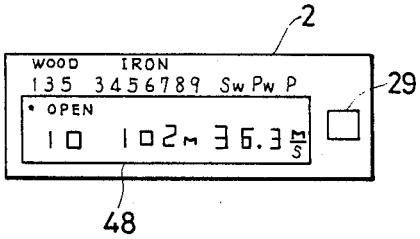
FIG. 27 is an example of a modified display of the present invention when a one wood is selected.
Figure 28:
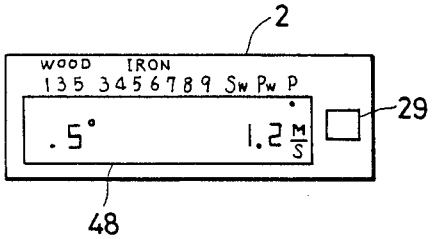
FIG. 28 is an example of this display when a putter is selected.
Figure 24:
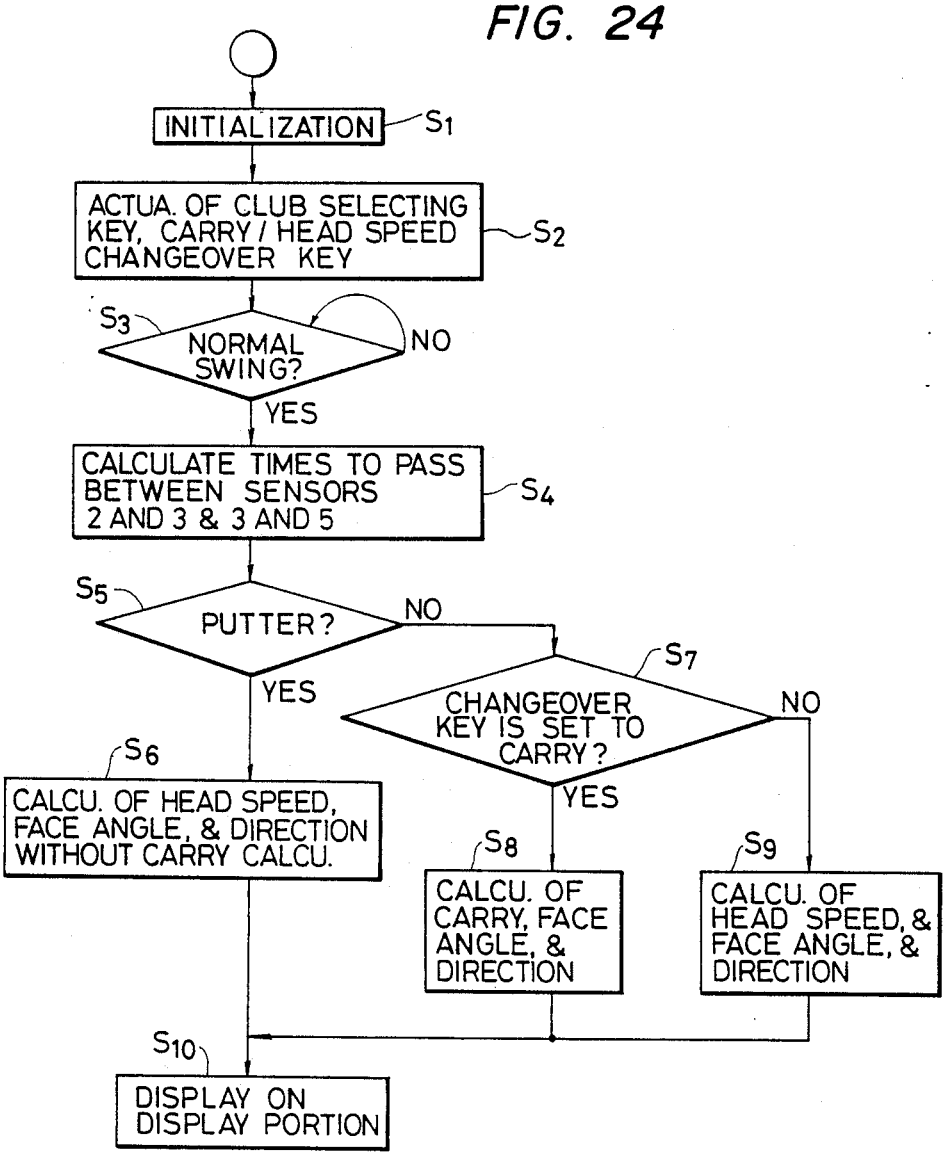
FIG. 24 is a flow chart illustrative of the steps of processing employed by the trainer.

FIGS. 27 and 28 show examples of the display of a golf trainer which has no carry/head speed changeover key but is provided with a display means normally displaying the head speed and carry simultaneously. FIG. 27 shows an example in which the one wood is selected, whereas FIG. 28 shows an example in which the putter is selected.

Figure 29:
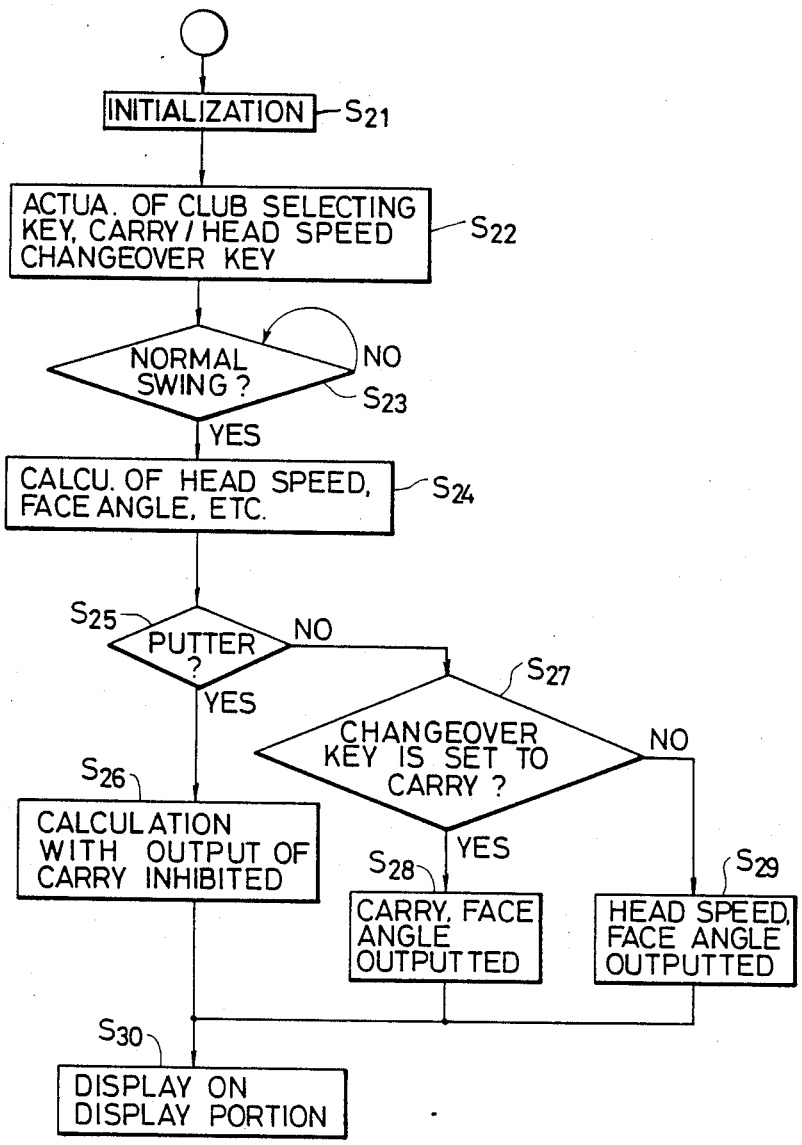
FIG. 29 is a flow chart illustrative of the steps of processing when using the modified display.

FIG. 29 shows an example of a flow chart for use, in this embodiment, and the steps of calculations or processing can also follow this flow chart.

It is obvious that the various information relative to the swing to be displayed after calculation or processing is not restricted to the aforementioned carry and head speed.

A further modified embodiment of the present invention will now be described with reference to FIGS. 30–32.

The display device 2 of this embodiment incorporates a central processing unit 115, which consists of a microprocessor, (described later in detail), a discrimination circuit 217 described later, a display portion (display means) 48 consisting of liquid crystal display devices, a club selecting key 29 which can be externally actuated, and a carry/head speed changeover key 110 which can also be externally actuated.

Figures 30, 32:
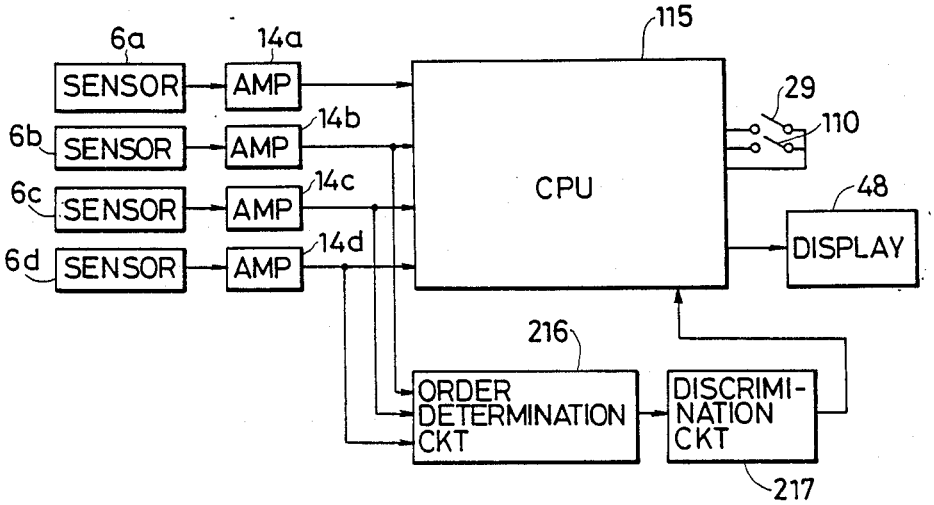
FIG. 30 is a block diagram of electronic circuit of a trainer according to a further embodiment.
FIG. 32 is a view illustrating one example of an order determination judgment in this embodiment.

Referring to FIG. 30, calculation circuits for calculating or processing various information concerning the swing are shown in the form of a block diagram. Amplifier circuits **14*a*–14*d* receive detected signals from the sensors 6*a*–6*d* when each passage of the club head just over the sensor is detected, and the circuits amplify the signals by a given gain factor. The circuit 216 receives the outputs from the amplifier circuits 14*b*–14*d*, and determines the order in which the club head passed the sensors 6*b*–6*d*. The discrimination circuit 217 receives the output of the circuit 216 and judges whether it follows a predetermined pattern or order. If it does, the circuit will produce a start signal which is applied to the central processing unit 115, which in turn calculates club head speed V, face angle $\alpha$, carry, direction and so on based on the inputs in accordance with the flow chart of FIG. 31, using the various formulae described previously. The display portion 48** receives the results of this processing and displays it digitally or graphically. Generally, calculations of various information relative to a swing requires the measurement of periods of time $t_y$ and $t_x$ described above, because these are fundamental factors for calculations. Accordingly, if these can be measured, the swing may be said to be correct.

Accordingly, if the periods of time $t_y$ and $t_x$ cannot be measured, then these calculations cannot be made, and common sense tells us that a normal swing has not taken place.

In view of the above, the order in which the signals from the sensors **6*b*–6*d*** associated with the times $t_y$ and $t_x$ are generated is determined, and this order is compared with a pattern or order which is normal. Only when both orders coincide are calculations made and data displayed. This prevents odd data due to a mistaken swing, or, for example, a backswing from being displayed, which would otherwise confuse the user.

Figure 31:
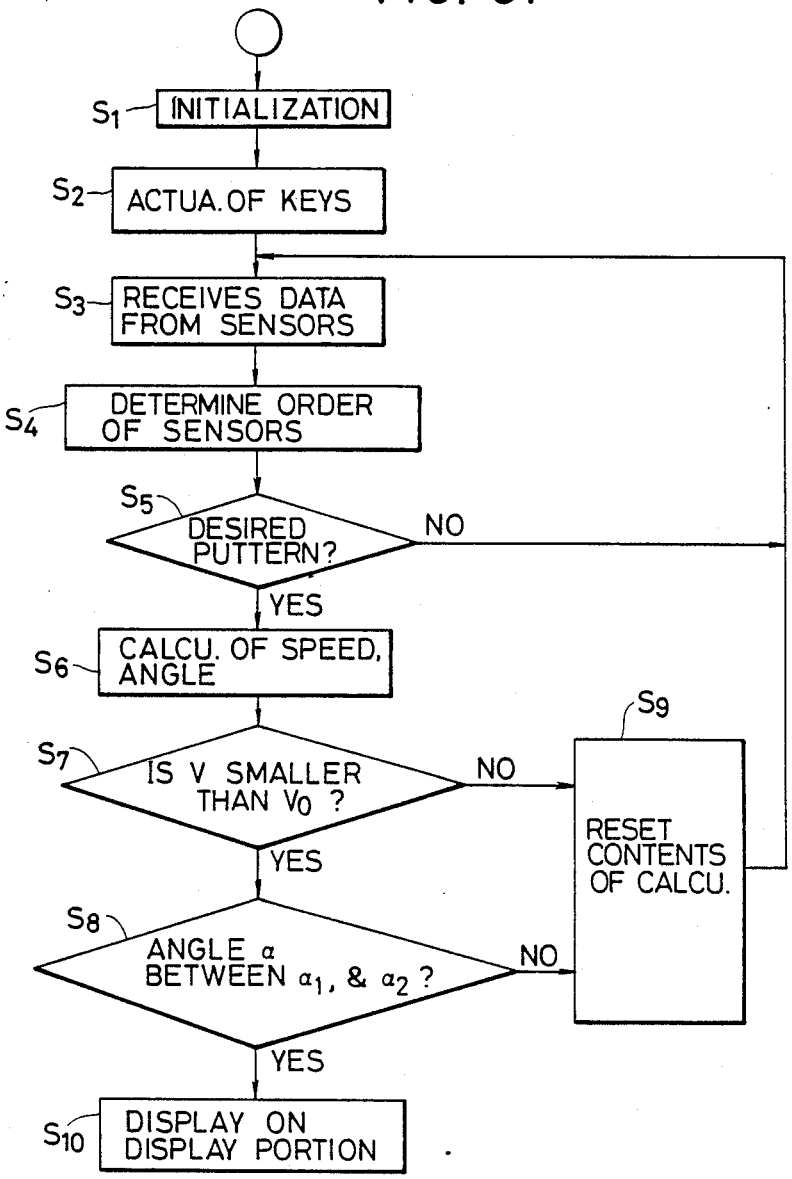
FIG. 31 is a flow chart illustrating the process steps of the circuit.
Figure 33:
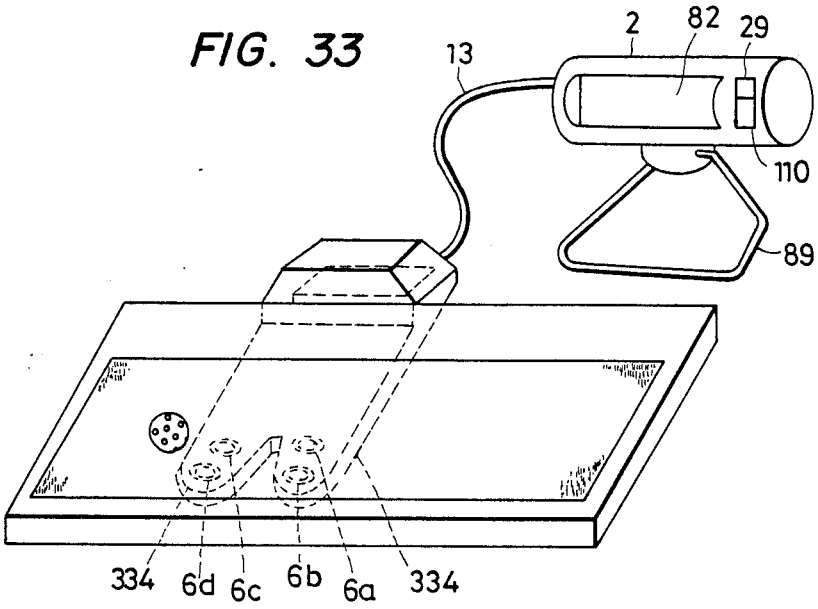
FIG. 33 is a perspective view of a still further embodiment of a golf trainer of this invention.
Figure 35:
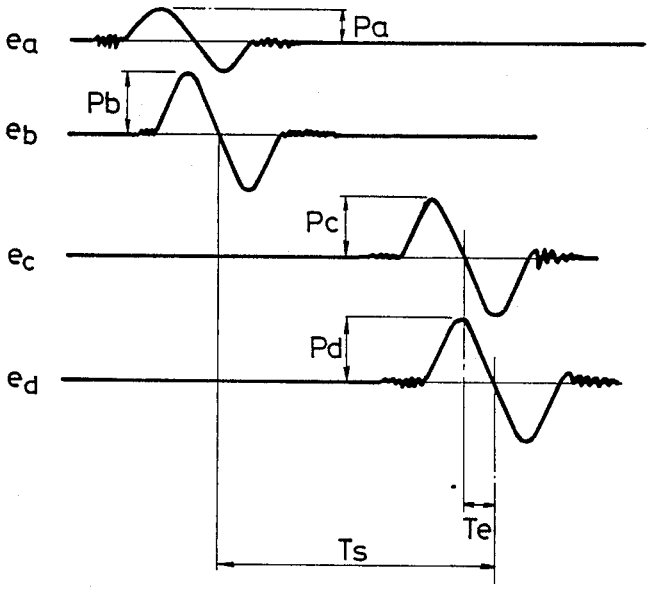
FIG. 35 shows the waveforms of the detected signals from the sensors of the trainer.

This embodiment is further advantageous in that resultant head speeds V slower than a predetermined value, for example 60 m/sec, and resultant face angles $\alpha$ within a predetermined range, for example, $-20° < \alpha < +20°$, may be displayed as normal swings on the display portion 48, as illustrated in FIG. 31.

A final embodiment of the present invention will hereinafter be described with reference to FIGS. 33–41.

Referring to these drawings, a sensor case 334 removably installed in the mat has a pair of fork-like portrusions which hold the signal generating magnetic sensors **6*a*, 6*b* and 6*c*, 6*d*, respectively, and the case also holds the first stage amplifier circuit therein. Each sensor consists of a coil wound on a bobbin and a permanent magnet inserted in the central bore in the bobbin. The display device 2 supported on a support 89 holds a processing circuit (described later) and a display portion 82 consisting of liquid crystals consuming little electricity. Further, the device 2 is provided with a club selecting key 29 and a carry/hold speed changeover key 110, both of which can be externally actuated. Electrical outputs from the sensor cases 334 are fed to the display device 2 through the connecting cord 13**.

Figure 34:
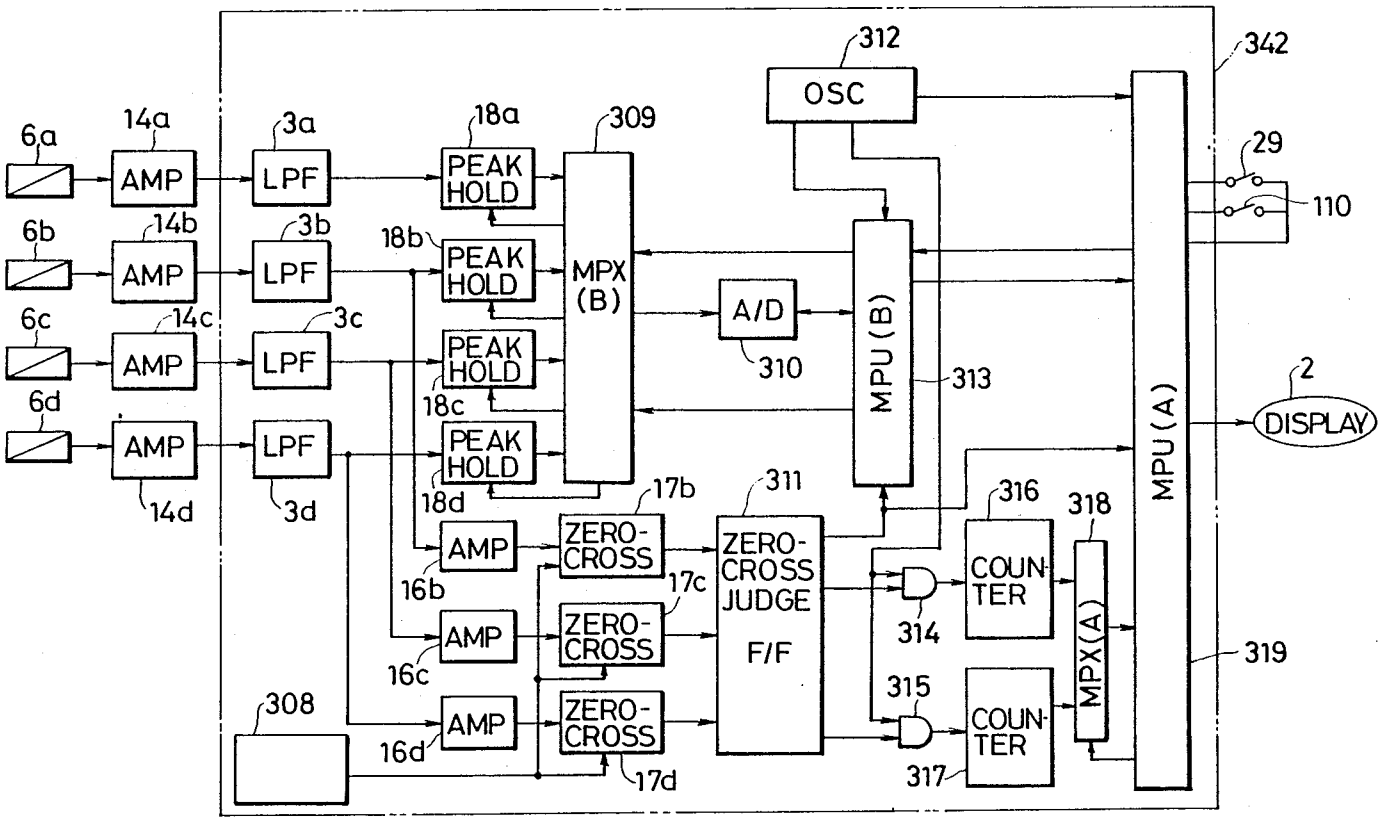
FIG. 34 is a block diagram of the electronic circuit of this trainer.

Referring next to FIG. 34, the structure of the processing circuit 342 will be described in detail. First stage amplifier circuits **14*a*–14*d* amplify outputs $e_a$, $e_b$, $e_c$ and $e_d$ from the sensors by a given gain factor. Low pass filter circuits 3*a*, 3*b*, 3*c* and 3*d*, abbreviated LPFs hereinafter, filter out high frequency components, e.g. high frequency noise induced in the sensors and included in outputs $E_a$, $E_b$, $E_c$ and $E_d$ from the first stage amplifier circuits. Peak holding circuits 18*a*–18*d* hold output voltage values from the LPFs, and a multiplexer circuit 309, abbreviated MPX hereinafter, converts outputs from the peak holding circuits into serial form in accordance with an instruction from a microprocessor 313 described later (abbreviated MPU hereinafter) and produces output signals $E_A$, $E_B$, $E_C$ and $E_D$. An analog-to-digital converter circuit 310, abbreviated A/D converter hereinafter, converts the outputs from the MPX 309 in succession into signals $T_A$, $T_B$, $T_C$ and $T_D$. Indicated by numeral 313 is an MPU which produces a signal that resets the peak holding circuits 18*a*–18*d* via the MPX 309 after receiving an output from the A/D converter. A start signal from a zero-crossing judging flip-flop 311 causes the MPU 313 to calculate the relative positions between the club head and the sensors 6*a*, 6*b* and the relative positions between the head and the sensors 6*c*, 6*d* based on clock pulses from a pulse oscillator circuit 312**.

Figure 36:
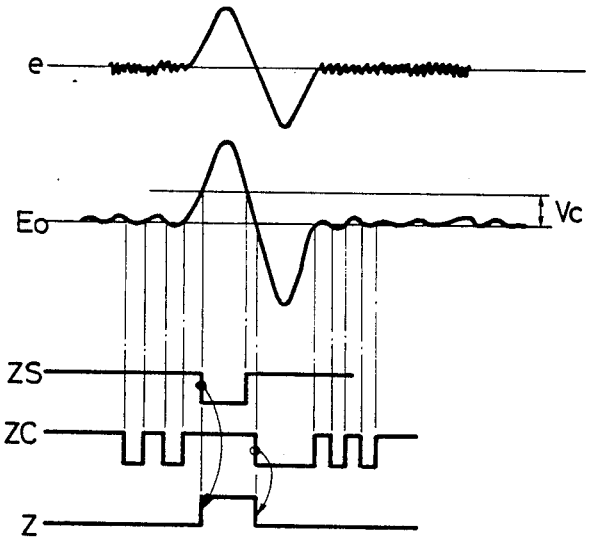
FIG. 36 is a timing chart showing how a zero-crossing waveform is detected.
Figure 37:
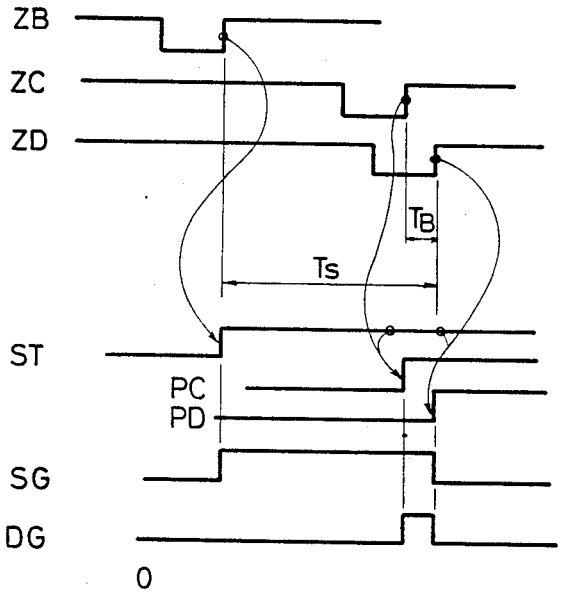
FIG. 37 is a timing chart of the signals applied to the counter circuits.
Figure 38:
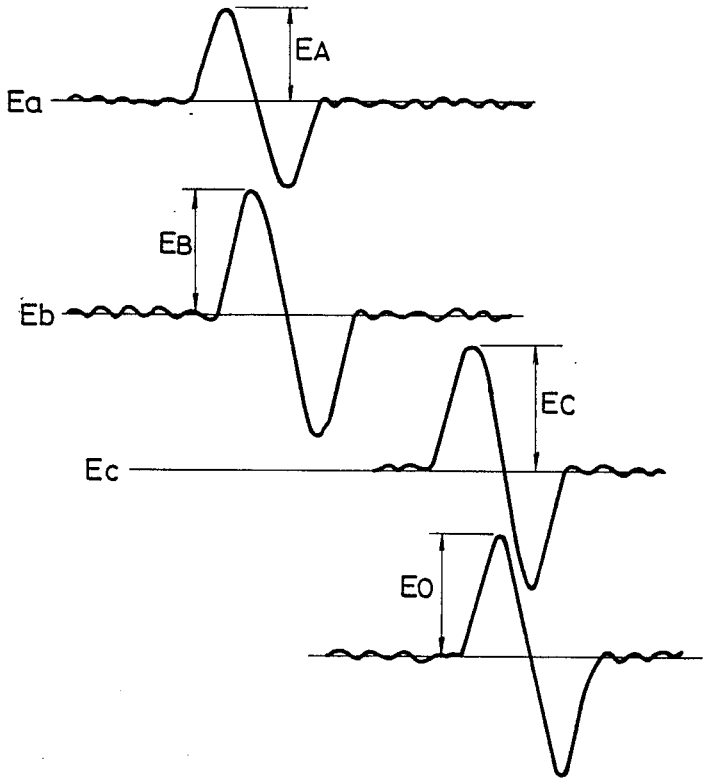
FIG. 38 shows the waveform of signals that have passed through the respective low pass filters.
Figure 39:
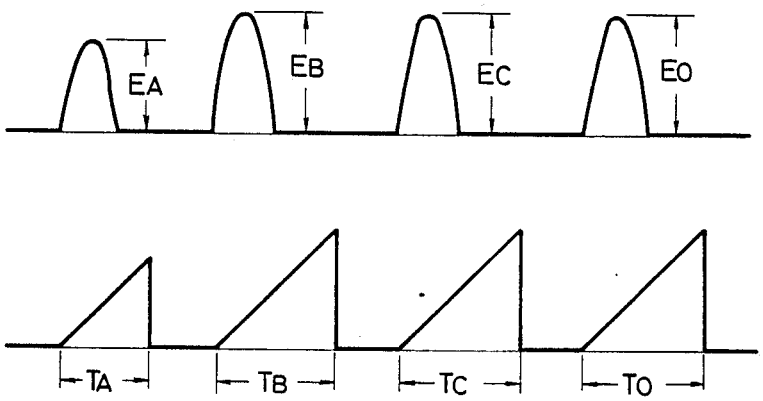
FIG. 39 is a conceptual view of the signals after their analog-to-digital conversion.

Amplifier circuits **16*b*, 16*c* and 16*d* amplify the output signals from the LPFs 3*b*, 3*c* and 3*d*, respectively. Zero-crossing circuits 17*b*, 17*c* and 17*d* each produce a zero-crossing signal Z from a respective one of the output signals of the amplifier circuits 16*b*, 16*c* and 16*d* based on the output $V_c$ from a reference voltage generating circuit 308 for low frequency cutoff as shown in FIG. 36. The zero-crossing judging flip-flop circuit 311 receives the outputs and processes them to produce ST, PC and PD signals based on the respective zero-crossing signals $Z_B$, $Z_C$ and $Z_D$ as shown in FIG. 37**. The flip-flop circuit further produces $S_G$ and $D_G$ signals.

An AND circuit 314 for the velocity receives the $S_G$ signal and ANDs the pulse width $T_S$ of this signal with a clock pulse from the clock pulse oscillator circuit 312, abbreviated OSC hereinafter. Similarly, an AND circuit 315 for the angle receives the $D_G$ signal and ANDs the pulse width $T_O$ of this signal with a clock pulse from the OSC 312. Counter circuits 316 and 317 count the clock pulses during the pulse widths $T_S$ and $T_O$, respectively. Indicated by numeral 319 is a MPU which recevies a ST(start) signal from the zero-crossing judging flip-flop 311 and successively receives the contents of the counter circuits 316 and 317 via the MPX 318. The MPU 319 then makes various calculations and receives calculated information from the MPU 313 only when any result of its calculations exceeds a predetermined value, for example 2 m/sec with respect to the speed of club head. Then the information is graphically displayed on the display portion 2 consisting of liquid crystals as a piece of information, such as the head speed, carry, face angle, delivery angle, hitting position, club orbit, distance from target, etc., and the displayed information is selected by the settings of the club selecting key 29 and a carry/head speed changeover key 110.

Before a golf swing is practiced using the structure described hereinbefore, the club to be used is selected by the club selecting key 29. Then, either carry or head speed display is selected by the carry/head speed changeover key 110, thus completing the preparation for swing training. Then, if a golfer swings the club, a display will be made on the display portion 2 in response thereto.

In reality, when a five iron, for example, is swung by a professional golfer, the club head speed at the moment of impact may reach 50 m/sec. Supposing that the interval to be measured for head speed, in this embodiment, between the sensors **6*b* and 6*d*, is 10 cm in length (see FIG. 4), the period of time it takes for a club head moving at the aforementioned velocity of 50 m/sec to pass through this interval is 2 milliseconds. When the orientation of the club face is measured, if the interval between the sensors 6*c* and 6*d*** is assumed to be 4 cm, then the period of time it takes for the club head to pass through this interval is shorter than the aforementioned period, and data occurring on the order of 10 microseconds must be processed.

The measurement of time can be made by microprocessors, as aforesaid, but there is a limit in the processing speed of a microprocessor. For example, an ordinary microprocessor takes a few microseconds per instruction, and a complementary MOS microprocessor takes dozens of microseconds per instruction. Further, at least about a dozen instructions are required for time measurement, thus rendering the measurement inaccurate.

In constrast to this, as aforesaid stated above, the present invention is characterized in that two microprocessors are used simultaneously, and in that counter circuits for counting high-speed clock pulses to measure periods of time are provided, the counter circuits producing output signals on the order of a few milliseconds to thus enable the microprocessors to process such high-speed data precisely. Further, owing to these features, a device which calculates numerous values and displays each result, as in this embodiment, can make precise displays rapidly after a swing.

It is noted that the above embodiment employs two counter circuits, but the number is obviously not restricted to two.

Thus, in accordance with the present invention, a golf trainer can be provided which comprises a plurality of sensors for detecting a swinging club head, an oscillator circuit for generating high frequency clock pulses, counter circuits each of which counts the number of clock pulses generated during the period of time it takes for the club head to pass through a respective one of the intervals between the sensors, microprocessors for calculating or processing data on the swing based on outputs from the counter circuits, and a display portion for displaying the results of the processing, thereby permitting precise and rapid display immediately after the swing.

In accordance with the present invention, a golf trainer can also be provided which comprises sensors for detecting the club head state of a swinging club head, a means for processing signals from the sensors, a storage unit for temporarily storing the results of calculations concerning the swing, and a display portion for displaying the contents of the storage unit, the golf trainer being characterized by providing a means for producing a reset signal updating the contents of the storage by receiving the detected signals from the sensors, thus permitting automatic updating of the contents of the display portion, and rendering the operation very simple.

Thus, an advantageous golf trainer can be provided with a means for calculating the velocity of the club head based on detected signals from sensors, a means for converting the velocity into data corresponding to the carry of a ball based on data calculated by the calculating means, a memory for storing that data, and a display portion for displaying the data stored as carry of the golf ball, whereby permitting precise, rapid and objective display of the carry of a ball if there exists a space, for example an indoor space, allowing a swing of a golf club.

In accordance with another aspect of the present invention, a golf trainer can be had which comprises a central processing unit for calculating the carry of a ball based on statistical data defining the interrelationships between the speed of a club head and the carry of a ball to produce a signal indicative of the carry, and a display portion for displaying the output from the central processing unit, whereby any carry can be displayed accurately within a wide range of indication, thus greatly contributing to improvement in effectiveness of golf training.

Also, in accordance with the present invention, a golf trainer having a club selecting key is constructed so that it does not display the carry when a putter is selected, thereby permitting appropriate practice with a putter while necessitating only a simple operation of the trainer.

As aforesaid, the present invention provides a golf trainer comprising a plurality of sensors for detecting the moving state of a club head, a circulation circuit for calculating the speed of the club head based on the signals detected and a display means for displaying the results of this calculation, the trainer being characterized in that only when the order in which the club head passes the sensors coincides with a predetermined pattern or order is the calculation circuit operated. As a result, only data resulting from swings judged to be normal is displayed by setting the predetermined pattern or patterns for normal swings, thus avoiding erroneous readings.

What is claimed is:

1. A golf trainer; comprising;

at least one sensor for detecting a swinging golf club head to produce detection signals, golf club selecting means for selecting a golf club head to be used with said golf trainer, signal generating means for processing said detection signals to produce signals which permit calculation of the velocity of a head of said selected golf club, converter means for processing output signals from the signal generating means and said golf club selecting means to calculate the velocity of the club head and to convert said velocity into data corresponding to the carry of a golf ball hit by said selected golf club, a memory for storing data output by said converter means, and display means for displaying the data stored in said memory.

2. A golf trainer as claimed in claim 1, wherein said converter means comprises a club data memory for storing predetermined club data individually set for various clubs, a club data selector for selecting club data corresponding to the club selected by said golf club selecting means from the club data in said club data memory, and a means for calculating the velocity of said club head by processing the signals from said signal generating means and for calculating said carry of the ball using said club data selected by said club data selector in a predetermined order of calculation.

3. A golf trainer as set forth in claim 1, wherein said converter means comprises a club data memory for storing predetermined calculation programs individually set for various clubs, a club data selector for selecting a calculation program corresponding to a club selected by said golf club selecting means from the calculation programs in said club data memory, and means for calculating the velocity of said club head by processing output signals from said signal generating means and for converting the velocity into data corresponding to the carry of the ball in accordance with the calculation program selected by said club data selector.

4. A golf trainer, comprising;

at least one sensor for detecting a swinging club head to produce detection signals, golf club selecting means for selecting a golf club to be used with said trainer, signal generating means for processing said detection signals to produce signals which permit calculation of the velocity of said club head, converter means for processing output signals from said signal generating means and said golf club selecting means to calculate the velocity of said club head and to convert said velocity into data corresponding to the carry of a golf ball hit by the golf club selected by the golf club selecting means based on statistical data defining interrelationships between the velocity of a club head and the carry of a golf ball, a memory for storing data output by said converter means, and display means for displaying the data stored in said memory.

5. A golf trainer as claimed in claim 4, wherein said converter means comprises a club data memory for storing predetermined club data individually set for various clubs based on statistical data defining interrelationships between the velocity of a club head and the carry of a golf ball, a club data selector for selecting club data corresponding to the club selected by said golf club selecting means from said club data in said club data memory, and means for calculating the velocity of said club head by processing output signals from said signal generating means and for calculating the carry of the ball using said club head data selected by said club data selector in a predetermined order of calculation.

6. A golf trainer as set forth in claim 4, wherein said converter means comprises a club data memory for storing predetermined calculation programs individually set for various clubs based on statistical data defining interrelationships between the velocity of a club head and the carry of a golf ball, a club data selector for selecting a calculation program corresponding to the club selected by said golf club selecting means from the calculation programs in said club data memory, and means for calculating the velocity of the club head by processing output signals from said signal generating means and for converting said velocity into data corresponding to the carry of the ball in accordance with said calculation program selected by said club data selector.

7. A golf trainer, comprising;

a plurality of magnetic sensors disposed at a given interval in the direction of a golf club swing for generating outputs when the golf club passes said sensors, pulse signal generating means for selecting zero-crossing points of said sensor outputs to produce a pulse signal at each zero-crossing point, oscillator means for generating high frequency clock pulses, time measuring means for counting the number of said clock pulses in an interval between a first and a second pulse signal generated asynchronously by said pulse signal generating means to measure the period of time it takes for said golf club to pass through said given interval, club selecting means for selecting a golf club to be used with said trainer, converter means for calculating the velocity of said club head from the period of time measured by said time measuring means and the distance between said sensors, and for converting said data into data corresponding to the carry of a golf ball hit by the golf club selected by said club selecting means, a memory for storing data ouptut by the converter means, and display means for displaying the data stored in said memory.

8. A golf trainer as set forth in claim 7, wherein said converter means comprises a club data memory for storing predetermined calculation programs individually set for various clubs, a club data selector for selecting a calculation program corresponding to the club selected by said golf club selecting means from the calculation programs in the club data memory, and means for calculating the velocity of the club head from both the period of time measured by said time measuring means and the distance between the sensors and for converting the velocity into data corresponding to the carry of the ball in accordance with the calculation program selected by said club data selector.

9. A golf trainer as set forth in claim 7, wherein said converter means comprises a club data memory for storing predetermined calculation programs which are individually set for various clubs based on statistical data defining interrelationships between the velocity of a club head and the carry of a golf ball, a club data selector for selecting a calculation program corresponding to the club selected by said golf club selecting means from the calculation programs in said club data memory, and means for calculating the velocity of said club head from both the period of time measured by said time measuring means and the distance between the sensors and for calculating, using the velocity of said club head and said club data selected by said club data selector, in a predetermined order of calculation, to obtain data corresponding to the carry of the ball.

10. A golf trainer, comprising;

at least one sensor for detecting a swinging golf club head to produce detection signals, golf club selecting means for selecting a golf club head to be used with said trainer, signal generating means for processing said detection signals to produce signals which permit calculation of the velocity of the club head, converter means for processing output signals from the signal generating means and the golf club selecting means to calculate the velocity of the club head and to convert the velocity into data corresponding to the carry of a golf ball hit by the golf club selected by said golf club selecting means, a memory for storing the output data of said converter means, display means for displaying the data stored in said memory, and means for preventing the said display means from displaying the carry of the ball when a putter is selected by said club selecting means.

11. A golf trainer, comprising;

at least one sensor for detecting a swinging club head to produce detection signals, golf club selecting means for selecting a golf club to be used, signal generating means for processing said detection signals to produce signals which permit calculation of the velocity of the club head, converter means for processing output signals from the signal generating means and the golf club selecting means to calculate the velocity of the club head and to convert the velocity into data corresponding to the carry of a golf ball hit by the golf club selected by the golf club selecting means based on statistical data defining interrelationships between the velocity of a club head and the carry of a golf ball, a memory for storing data output by said converter means, display means for displaying the data stored in said memory, and means for preventing the display means from displaying the carry of the ball when a putter is selected by said club selecting means.

12. A golf trainer, comprising;

a plurality of magnetic sensors disposed at a given interval in the direction of a golf club swing for generating respective outputs when the golf club passes the sensors, pulse signal generating means for selecting zero-crossing points of the outputs of the sensors to produce a pulse signal at each zero-crossing point, oscillator means for generating a high frequency clock pulses, time measuring means for counting the number of clock pulses in an interval between a first and a second pulse signal generated asynchronously by said pulse signal generating means to measure the period of time it takes for the golf club to pass through said given interval, club selecting means for selecting a golf club to be used, converter means for calculating the velocity of the club head from both the period of time measured by said time measuring means and the distance between the sensors and for converting the data into data corresponding to the carry of a golf ball hit by the golf club selected by said club selecting means, a means for storing data output by said converter means, display means for displaying the data stored in said memory, and means for preventing the display means from displaying the carry of the ball when a putter is selected by said club selecting means.

13. A golf trainer, comprising;

at least one sensor for detecting a swinging golf club head to produce detection signals, golf club selecting means for selecting a golf club head to be used with said trainer, signal generating means for processing said detection signals to produce signals which permit calculation of the velocity of the club head, converter means for processing the output signals from the signal generating means and the golf club selecting means to calculate the velocity of the club head and to convert the velocity into data corresponding to the carry of a golf ball hit by the golf club selected by said golf club selecting means, a memory for storing the data output by said converter means, display means for displaying the data stored in said memory, and a means for producing a reset signal which resets said memory upon production of said detection signals.

14. A golf trainer as set forth in claim 13, wherein said means for producing a reset signal operates to produce such reset signal when a velocity of the club head as calculated by said converter means is within a predetermined range.

15. A golf trainer as set forth in claim 13, wherein said means for producing a reset signal operates to produce such reset signal when a velocity of the club head as calculated by said converter means is in excess of a predetermined value.

16. A golf trainer, comprising:

at least one sensor for detecting a swinging club head to produce detection signals, golf club selecting means for selecting a golf club to be used with said trainer, signal generating means for processing said detection signals to produce signals which permit calculation of the velocity of the club head.

converter for processing output signals from the signal generating means and the golf club selecting means to calculate the velocity of the club head and to convert the velocity into data corresponding to the carry of a golf ball hit by the golf club selected by the golf club selecting means based on statistical data defining interrelationships between the velocity of a club head and the carry of a golf ball, a memory for storing data output by said converter means, display means for displaying the data stored in said memory, and means for producing a reset signal which resets said memory upon production of said detection signals.

17. A golf trainer, comprising;

a plurality of magnetic sensors disposed at a given interval in the direction of a golf club swing for generating respective outputs when the golf club passes thereover, pulse signal generating means for selecting zero-crossing points of the outputs of the sensors to produce a pulse signal at each zero-crossing point, oscillator means for generating high frequency clock pulses, time measuring means for counting the number of the clock pulses in an interval between first and second pulse signals generated asynchronously by said pulse signal generating means to measure the period of time it takes for the golf club to pass through said interval between said sensors, club selecting means for selecting a golf club to be used with said trainer, converter means for calculating the velocity of the club head from both the period of time measured by said time measuring means and the distance between the sensors and for converting said data into data corresponding to the carry of a golf ball hit by a golf club selected by said club selecting means, a memory for storing data output by said converter means, display means for displaying the data stored in said memory, and means for producing a reset signal for resetting said memory when said sensors produce said output signals.

18. A golf trainer, comprising;

a plurality of sensors for detecting a swinging golf club head to produce detection signals, golf club selecting means for selecting a golf head to be used with said trainer, signal generating means for processing said detection signals from said sensors to produce signals which permit calculation of the velocity of the club head, converter means for processing output signals from the signal generating means and the golf club selecting means to calculate the velocity of the club head and to convert the velocity into data corresponding to the carry of a golf ball hit by a golf club selected by the golf club selecting means, a memory for storing the data output by said converter means, display means for displaying the data stored in said memory, means for determining an order in which the club head passed said sensors, and discrimination means for receiving the output from the determining means and comparing said output with a predetermined pattern, said discrimination means producing a signal causing said converter means to calculate the velocity of the club head when the output and the pattern coincide with each other.

19. A golf trainer, comprising;

a plurality of sensors for detecting a swinging golf club head to produce detection signals, golf club selecting means for selecting a golf club head to be used with said trainer, signal generating means for processing said detection signals from said sensors to produce signals which permit calculation of the velocity of the club head, converter means for processing output signals from the signal generating means and the golf club selecting means to calculate the velocity of the club head and to convert the velocity into data corresponding to the carry of a golf ball hit by a golf club selected by the golf club selecting means on statistical data defining interrelationships between the velocity of a club head and the carry of a golf ball, a memory for storing the data output by said converter means, display means for displaying the data stored in said memory, means for determining the order in which the club head passed said sensors, and discrimination means for receiving an output from said determining means and comparing said output with a predetermined pattern, said discrimination means producing a signal causing said converter means to calculate the velocity of the club head when the output and the predetermined pattern coincide with each other.

20. A golf trainer, comprising;

club selecting means for selecting a golf club to be used with said trainer, a plurality of magnetic sensors disposed at a given interval in the direction of a golf club swing for generating respective outputs when the golf club passes said sensors, pulse signal generating means for selecting zero-crossing points of said outputs of said sensors to produce a pulse signal at each zero-crossing point, oscillator means for generating high frequency clock pulses, time measuring means for counting the number of clock pulses in an interval between first and second pulse signals generated asynchronously by said pulse signal generating means to measure the period of time it takes for the golf club to pass through said interval between said sensors, converter means for calculating the velocity of the club head from both the period of time measured by said time measuring means the distance between the sensors and converting said data into data corresponding to the carry of a golf ball hit by a golf club selected by said club selecting means, a memory for storing data output by said converter means, display means for displaying the data stored in said memory, means for determining the order in which the club head passed said sensors, and discrimination means for receiving the output from said determining means and comparing said output with a predetermined pattern, said discrimination means producing a signal causing said converter means to calculate the velocity of the club head when the output and the predetermined orders coincide with each other.

* * * * *